US009833110B2

(12) United States Patent
Stafford et al.

(10) Patent No.: US 9,833,110 B2
(45) **Date of Patent: *Dec. 5, 2017**

(54) BATHTUB DOOR SYSTEMS AND METHODS

(71) Applicant: Safeway Safety Step, LLC, West Chester, OH (US)

(72) Inventors: Christopher Brian Stafford, Liberty Township, OH (US); Michael Anthony Serraino, Cincinnati, OH (US)

(73) Assignee: Safeway Safety Step, LLC, West Chester, OH (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/822,363

(22) Filed: Aug. 10, 2015

(65) Prior Publication Data

US 2015/0342418 A1 Dec. 3, 2015

Related U.S. Application Data

(63) Continuation of application No. 13/362,612, filed on Jan. 31, 2012, now Pat. No. 9,131,809.

(60) Provisional application No. 61/438,185, filed on Jan. 31, 2011.

(51) Int. Cl.
*A47K 3/00* (2006.01)

(52) U.S. Cl.
CPC ..... *A47K 3/006* (2013.01)

(58) Field of Classification Search
CPC ..... A47K 3/006
See application file for complete search history.

(56) References Cited

U.S. PATENT DOCUMENTS

| | | | |
|---|---|---|---|
| 2,075,933 | A | 4/1937 | Friedlander |
| 2,520,129 | A | 8/1950 | Dall et al. |
| 2,569,825 | A | 10/1951 | Otis |
| 2,991,482 | A | 7/1961 | Brass |
| 3,066,316 | A | 12/1962 | Russell |
| 3,380,078 | A | 4/1968 | Hanson |
| 3,416,166 | A | 12/1968 | Hanson |
| 3,439,506 | A | 4/1969 | Martin |
| 3,663,971 | A | 5/1972 | Bonhote |
| 3,719,960 | A | 3/1973 | Russell |
| 3,971,080 | A | 7/1976 | Walker |
| 4,067,071 | A | 1/1978 | Altman et al. |
| 4,092,037 | A | 5/1978 | Greenwald |
| 4,158,585 | A | 6/1979 | Wright |
| 4,360,935 | A | 11/1982 | Barrett, Sr. |

(Continued)

FOREIGN PATENT DOCUMENTS

| | | | |
|---|---|---|---|
| CN | 102413747 | A | 4/2012 |
| DE | 20214218 | U1 | 1/2003 |

(Continued)

OTHER PUBLICATIONS

Door Insert Kit Installation Manual, Safety Bath Inc., dated Mar. 2008, 17 pages. Ituna SK, Canada.

(Continued)

*Primary Examiner* — Janie Loeppke
(74) *Attorney, Agent, or Firm* — Ulmer & Berne LLP

(57) ABSTRACT

A bathtub insert can include a frame, a door movably coupled with the frame and movable with respect to the frame between an opened position and a closed position, an elongate latch coupled with the door, a catch coupled with the frame, and a support structure, the support structure being coupled to the frame.

20 Claims, 16 Drawing Sheets

(56) References Cited

U.S. PATENT DOCUMENTS

| | | | |
|---|---|---|---|
| 4,364,132 | A | 12/1982 | Robinson |
| 4,542,545 | A | 9/1985 | Johnson et al. |
| 4,546,506 | A | 10/1985 | Houle et al. |
| 4,553,299 | A | 11/1985 | Ebert |
| 4,561,160 | A | 12/1985 | Nicol et al. |
| 4,796,312 | A | 1/1989 | Corlew |
| 4,802,247 | A | 2/1989 | Leichle et al. |
| 4,890,341 | A | 1/1990 | Forbes |
| 4,953,241 | A | 9/1990 | Williams |
| 4,993,087 | A | 2/1991 | Roquebrune |
| 5,184,358 | A | 2/1993 | Gruidel et al. |
| 5,341,524 | A | 8/1994 | Zellner |
| 5,351,345 | A | 10/1994 | Sills et al. |
| 5,446,929 | A | 9/1995 | Sills et al. |
| 5,463,780 | A | 11/1995 | McAllister et al. |
| 5,560,092 | A | 10/1996 | Roiger |
| 5,606,751 | A | 3/1997 | Baker |
| 5,628,851 | A | 5/1997 | Lawler |
| 5,701,614 | A | 12/1997 | Appleford et al. |
| 6,061,846 | A | 5/2000 | Peterson |
| 6,085,367 | A | 7/2000 | Guiste |
| 6,212,704 | B1 | 4/2001 | Peterson |
| 6,226,810 | B1 | 5/2001 | Weddendorf et al. |
| 6,256,806 | B1 | 7/2001 | DiTommaso |
| 6,272,698 | B1 | 8/2001 | Stafford |
| 6,334,225 | B1 | 1/2002 | Brinkmann |
| 6,381,769 | B1 | 5/2002 | Lofquist, Jr. |
| 6,430,759 | B1 | 8/2002 | Beltran |
| 6,615,420 | B1 | 9/2003 | Hyden et al. |
| 6,766,543 | B1 | 7/2004 | Hollis et al. |
| D539,398 | S | 3/2007 | Stafford |
| 7,237,276 | B2 | 7/2007 | Longman |
| 7,299,509 | B1 | 11/2007 | Neidich et al. |
| 7,778,937 | B2 | 8/2010 | Ferrara et al. |
| 7,926,126 | B2 | 4/2011 | Whitley |
| 8,230,568 | B2 | 7/2012 | Stafford |
| 8,375,478 | B2 | 2/2013 | Luo |
| 8,505,128 | B2 | 8/2013 | Staudinger |
| 8,898,824 | B2 | 12/2014 | Neidich et al. |
| 8,904,614 | B2 | 12/2014 | Stafford |
| 9,131,809 | B2 | 9/2015 | Stafford et al. |
| 2004/0064883 | A1 | 4/2004 | Appleford et al. |
| 2004/0237184 | A1 | 12/2004 | Longman |
| 2005/0044620 | A1 | 3/2005 | Metcalf |
| 2005/0102746 | A1 | 5/2005 | Wright et al. |
| 2006/0080772 | A1 | 4/2006 | Saiz et al. |
| 2006/0230526 | A1 | 10/2006 | Skinner |
| 2008/0000158 | A1 | 1/2008 | Ranelli et al. |
| 2008/0083063 | A1 | 4/2008 | Libit et al. |
| 2008/0087283 | A1 | 4/2008 | Cromack et al. |
| 2008/0092361 | A1 | 4/2008 | Neidich |
| 2008/0109954 | A1 | 5/2008 | Neidich |
| 2008/0111383 | A1 | 5/2008 | Van Ravenhorst |
| 2008/0222787 | A1 | 9/2008 | Staudinger |
| 2009/0010420 | A1 | 1/2009 | Khanna |
| 2010/0037382 | A1 | 2/2010 | Spiker et al. |
| 2010/0156120 | A1 | 6/2010 | Luo |
| 2010/0212083 | A1 | 8/2010 | Stafford |
| 2010/0236041 | A1 | 9/2010 | Stafford |
| 2010/0263119 | A1 | 10/2010 | Neidich et al. |
| 2011/0307547 | A1 | 12/2011 | Backer et al. |
| 2012/0005820 | A1 | 1/2012 | Stafford |
| 2012/0102013 | A1 | 4/2012 | Martini |
| 2012/0123667 | A1 | 5/2012 | Gueziec |
| 2012/0216343 | A1 | 8/2012 | Stafford et al. |
| 2012/0284122 | A1 | 11/2012 | Brandis |
| 2012/0303402 | A1 | 11/2012 | Koury |
| 2012/0304376 | A1 | 12/2012 | Neidich et al. |
| 2013/0051546 | A1 | 2/2013 | Fried et al. |
| 2013/0051549 | A1 | 2/2013 | Klemm |
| 2013/0090957 | A1 | 4/2013 | Popkey et al. |
| 2013/0127634 | A1 | 5/2013 | Grumbles, III |
| 2013/0304534 | A1 | 11/2013 | Mehta et al. |
| 2014/0040282 | A1 | 2/2014 | Mann et al. |
| 2015/0063900 | A1 | 3/2015 | Stafford |
| 2015/0305573 | A1 | 10/2015 | Stafford et al. |
| 2015/0335206 | A1 | 11/2015 | Stafford et al. |
| 2015/0342418 | A1 | 12/2015 | Stafford et al. |
| 2016/0000272 | A1 | 1/2016 | Jin |

FOREIGN PATENT DOCUMENTS

| | | | |
|---|---|---|---|
| EP | 0 123 324 | B1 | 10/1984 |
| EP | 0 151 571 | | 8/1985 |
| EP | 0 162 103 | | 11/1985 |
| EP | 0 188 412 | B1 | 7/1986 |
| EP | 0 585 564 | B1 | 3/1994 |
| EP | 0 700 655 | A1 | 3/1996 |
| EP | 0 864 285 | A2 | 9/1998 |
| EP | 0 913 115 | A1 | 5/1999 |
| EP | 0 933 052 | A2 | 8/1999 |
| EP | 0 710 080 | B1 | 11/1999 |
| EP | 1 447 038 | A2 | 2/2004 |
| EP | 1 428 467 | A1 | 6/2004 |
| EP | 1 747 747 | A2 | 1/2007 |
| GB | 2 381 746 | A | 5/2003 |
| JP | 10-137313 | A | 5/1998 |
| JP | 2000-271185 | A | 1/2000 |
| JP | 2002-336325 | A | 11/2002 |
| WO | 2008/110010 | A1 | 9/2008 |
| WO | 2010/099410 | | 9/2010 |
| WO | 2010/099410 | | 3/2011 |
| WO | 2012088255 | A1 | 6/2012 |
| WO | 2012/106339 | | 8/2012 |

OTHER PUBLICATIONS

GreyB Services, Validity Search Report, dated Aug. 25, 2008.

International Search Report and Written Opinion of the International Searching Authority, issued in International Application No. PCT/US11/66451; dated May 1, 2012, in its entirety.

International Search Report and Written Opinion of the International Searching Authority, issued in International Application No. PCT/US2012/023326; dated Sep. 25, 2012, 9 pages in its entirety.

Mexican Patent Application No. 11/08992, filed Aug. 26, 2011.

International Preliminary Report on Patentability for PCT Publication No. WO2010/099410, dated Sep. 9, 2011, 10 pages in its entirety.

International Search Report and Written Opinion of the International Searching Authority for PCT Publication No. WO2010/099410, dated Feb. 3, 2011, 13 pages in its entirety.

U.S. Appl. No. 29/551,991, filed Jan. 19, 2016.

BATHTUB DOOR SYSTEMS AND METHODS

CROSS-REFERENCE TO RELATED APPLICATION

This application is a continuation of U.S. non-provisional patent application Ser. No. 13/362,612, filed Jan. 31, 2012, which claims priority of U.S. provisional patent application Ser. No. 61/438,185, filed Jan. 31, 2011, which are hereby incorporated by reference herein in their entirety.

TECHNICAL FIELD

Embodiments herein relate, in general, to a bathtub insert having a door for allowing easier ingress and egress to/from a bathtub.

BACKGROUND

Traditional bathtubs may have high sidewalls, referred to as bathtub aprons, that allow a bathtub to hold a large volume of water. Many individuals, particularly the elderly and those suffering from arthritis, debilitating injury, handicap, and/or general loss of mobility, may have trouble accessing a bathtub area due to the high step that is typically required to step into and out of a bathtub. For such persons, the sidewall of a bathtub may be an insurmountable hurdle. Even with the assistance of a health aide, many individuals may not be capable of safely stepping over the sidewall of a bathtub and into the bathtub to take a bath or shower. Consequently, these persons may forego taking a bath or shower altogether and settle for alternative bathing methods, such as sponge baths and the like. Many people, however, may not find such alternative bathing methods satisfactory. Because the act of cleaning oneself may be considered by most people to be a very private affair, the need for the assistance of another person to use existing bathtubs or to participate in an alternative bathing method may be a very degrading and embarrassing experience. In addition, the presence of another person does not permit independence in the home.

SUMMARY

In accordance with one embodiment, a bathtub insert can include a frame including a step-plate and a pair of end pillars, the frame defining a cavity, a door movably coupled with the frame and movable with respect to the frame between an opened position and a closed position, a seal coupled to one of the frame and the door to provide a watertight seal between the frame and the door when the door is in the closed position, an elongate latch coupled with the door with a singular pivot pin having a singular pivot point such that the elongate latch is pivotable relative to the door, the elongate latch having a tapered portion, where the singular pivot pin is positioned at a bottom portion of the frame or the door, a catch coupled with the frame, the catch having a substantially vertical orientation and defining a channel member, the channel member having a substantially vertical orientation and forming a channel having a vertical length that is greater than its horizontal width, where the channel member is sized to receive the tapered portion of the elongate latch to retain and tension the door in the closed position to establish a substantially watertight seal between the door and the frame to selectively engage the latch to facilitate retention of the door in the closed position, and a support structure, the support structure being coupled to the frame.

In accordance with one embodiment, a bathtub can have a frame including a step-plate and a pair of end pillars, the frame defining a substantially U-shaped cavity, a door movably coupled with the frame and movable with respect to the frame between an opened position and a closed position such that the door swings inwardly into the bathtub in the opened position, a seal coupled to one of the frame and the door to provide a watertight seal between the frame and the door when the door is in the closed position, an elongate latch coupled with the door with a singular pivot pin having a singular pivot point such that the elongate latch is pivotable relative to the door, the elongate latch having a tapered portion, where the singular pivot pin is positioned at a bottom portion of the frame or the door, and a catch coupled with the frame, the catch having a substantially vertical orientation and defining a channel member, the channel member having a substantially vertical orientation and forming a channel having a vertical length that is greater than its horizontal width, where the channel member is sized to receive the tapered portion of the elongate latch to retain and tension the door in the closed position to establish a substantially watertight seal between the door and the frame.

In accordance with another embodiment, a bathtub insert can include a frame having a step-plate and a pair of end pillars, the frame defining a cavity, a door movably coupled with the frame and movable with respect to the frame between an opened position and a closed position, a seal coupled to one of the frame and the door to provide a watertight seal between the frame and the door when the door is in the closed position, an elongate latch coupled with the door with a singular pivot pin having a singular pivot point such that the elongate latch is pivotable relative to the door, the elongate latch having a tapered portion, where the singular pivot pin is positioned at a bottom portion of the frame or the door, a catch coupled with the frame, the catch having a substantially vertical orientation and defining a channel member, the channel member having a substantially vertical orientation and forming a channel having a vertical length that is greater than its horizontal width, where the channel member is sized to receive the tapered portion of the elongate latch to retain and tension the door in the closed position to establish a substantially watertight seal between the door and the frame to selectively engage the latch to facilitate retention of the door in the closed position, and a support structure, where the support structure is integral with the frame such that the support structure and the frame are a one piece construction.

BRIEF DESCRIPTION OF THE DRAWINGS

Various embodiments will become better understood with regard to the following description, appended claims and accompanying drawings wherein:

DETAILED DESCRIPTION

Versions of a bathtub insert described herein provide easier access to a bathtub. In one embodiment, a bathtub insert can be placed in a cutout section of a sidewall of a bathtub. This bathtub insert, when properly positioned with respect to the sidewall of the bathtub, can effectively lower the sidewall to permit easy access to the interior of the bathtub for those who might be physically challenged by the height of the sidewall of a typical bathtub.

Figure 1:
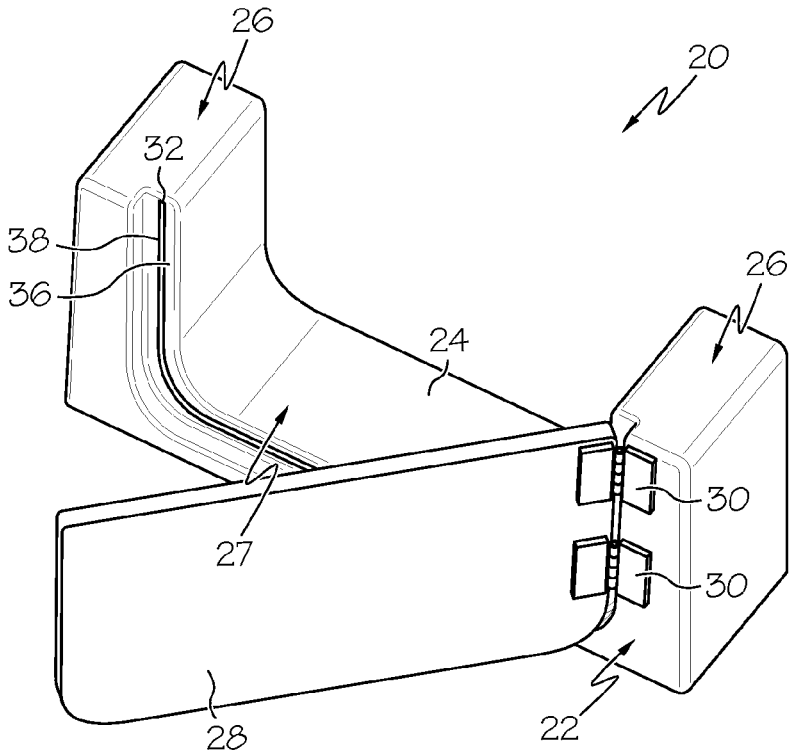
FIG. 1 is a perspective view depicting a bathtub insert including a door according to one embodiment, wherein the door is shown in a partially opened position.

Referring to FIG. 1, a bathtub insert 20 is shown according to one embodiment. The bathtub insert 20 is shown to include a frame 22 having a step-plate 24 and a pair of end pillars 26. The frame 22 can generally comprise a U-shaped structure having an opening 27 defined by the step-plate 24 and the end pillars 26. Step-plate 24 can be stepped over or upon by a user to gain access to the interior or exterior of a bathtub. The step-plate 24 can extend between the end pillars 26. The end pillars 26 can extend upwardly and generally perpendicularly from the step-plate 24 and generally parallel with each other.

The bathtub insert 20 can be retrofitted into an existing bathtub to facilitate effective egress/ingress into the bathtub. To facilitate installation of the bathtub insert 20, a generally U-shaped portion of a sidewall of the bathtub can be cut away to form a bathtub opening. In most instances, a bathtub has three sidewalls encased by adjacent walls and one sidewall exposed for ingress/egress. The bottom perimeter of the bathtub can be supported by an adjacent floor. The bathtub opening in the sidewall can be formed on the exposed sidewall and can have a length and height that facilitates effective installation of the bathtub insert 20. The length and height of the opening can be selected according to the configuration of the bathtub insert 20 and more specifically, the dimensions of frame 22. In some embodiments, the bathtub opening can be slightly smaller than the dimensions of frame 22 to allow for a secure and watertight coupling.

In some embodiments, a template can be provided over the sidewall to facilitate cutting and removal of the sidewall. Once the template is installed on the appropriate sidewall, an outline can be drawn or otherwise indicated on the sidewall of the bathtub, and the bathtub opening can be cut using appropriate tools as dictated by the composition of the bathtub.

Once the bathtub opening has been cut away, the bathtub insert 20 can be installed in the bathtub opening. The sides and/or the bottom of the frame 22 can be trimmed to fit appropriately over the bathtub opening and interact appropriately with adjacent portions of the sidewall. In one embodiment, the bathtub insert 20 can be trimmed or otherwise formed to fit directly into the bathtub opening without any overlap between the sidewall and the bathtub insert 20.

The bathtub insert 20 can be adhered to the bathtub and sealed to prevent leakage into/from the bathtub opening. In one embodiment, a plurality of waterproof sheets can be provided between the bathtub insert 20 and the bathtub. The waterproof sheets can be coated with an adhesive or other bonding agent to facilitate adhesion to the bathtub. The waterproof sheets can be a waterproof membrane similar to materials commonly used for roofing applications. In another embodiment, expandable foam or other suitable material(s) can be sprayed or applied to the top of the sidewall, in addition to or in lieu of the waterproof sheets. The expandable foam can be effective to fill voids or spaces between the sidewall and the frame 22 to provide a watertight seal between the sidewall and the bathtub insert 20. In yet another embodiment, a waterproof sealant or caulk can be applied to the entire perimeter of the bathtub opening to provide a watertight barrier. It will be appreciated that any of a variety of suitable alternative waterproofing material(s) and/or methods can be used. For example, materials used to seal the foundation of a house can be used. In another example, a plurality of pieces of lumber, Styrofoam, or other suitable material(s) can be cut to fit within the space between the sidewall and the bathtub insert 20 and adhered or fastened to the bathtub and/or the sidewall.

The bathtub insert 20 can substantially (e.g., substantially entirely or entirely) cover the opening such that the cut lines of the opening are concealed. The bathtub insert 20 can be sized such that the bathtub opening need not have precise dimensions and/or tight tolerances. The bathtub insert 20 can be configured to effectively seal the bathtub opening regardless of whether the bathtub opening is cut to the precise dimensions suggested for the installation. By way of example only, the bathtub insert 20 can be installed in accordance with methods described in U.S. Pat. No. 6,272,698, issued to Stafford, which is hereby incorporated by reference herein in its entirety. The bathtub insert 20 can be formed from any suitable material as will be apparent to one of ordinary skill in the art. For example, bathtub insert 20 can be made of a polymer, such as a polyethylene. The bathtub insert 20 can be fabricated using a rotational molding process or any other suitable method of fabrication.

Referring again to FIGS. 1-4, the bathtub insert 20 can comprise a door 28 that is pivotally coupled to the frame 22 with hinges 30. The door 28 can be movable between an opened position (shown in FIGS. 1-4) and a closed position (not shown). When in the opened position, the door 28 can permit effective access to the interior of the bathtub. When in the closed position, the door 28 can interact with the frame 22 to form a watertight seal such that the bathtub can retain fluid. The door 28 can comprise any suitable material as will be apparent to one of ordinary skill in the art such as a polymer (e.g., polyethylene), metal, stainless steel, ceramic, composite material, and/or glass.

It will be appreciated that door 28 can have any suitable construction or structure as will be apparent to one of ordinary skill in the art. For example, the door 28 can comprise a single panel formed as a one-piece construction. In another example, the door 28 can comprise a plurality of panels. Multi-panel versions of the door 28 can include an accordion configuration of a plurality of integral panels, two generally equally sized doors that meet towards the center of the bathtub insert 20 and swing inwardly, telescoping panels, and the like. For example, bathtub insert 20 can include two doors (not shown) that latch together in the middle. In another example, bathtub insert 20 can include two doors that function in a similar fashion to saloon doors, wherein one door can be closed and secured within a channel formed in frame 22 and the second door can be closed and secured within another channel formed in frame 22 with a latch, seal, or magnet. In another example, a door, or blocking member, can be lowered into the opening 27 of the bathtub insert 20 to effectively seal off the opening 27. The step-plate 24 and/or the end pillars 26 can cooperate to define a groove or plurality of grooves (not shown) along the perimeter of the opening (e.g., 27). After a bather has entered the bathtub, the door can be slid into the groove(s) and affixed to the frame in any suitable manner such as, for example, with a magnet and/or seal. In another example, the door can be configured as a saddle that can fully or partially obstruct the opening (e.g., 27) to effectively seal off the opening (e.g., 27). The saddle-type covering can be hinged to the frame 22 or configured for selective placement over the opening. Any suitable connector or seal can be located around all or a portion of the frame 22 to facilitate attachment of the door, blocking member, saddle-type covering, or the like.

Referring again to FIG. 2, the pair of hinges 30 are coupled to one of the end pillars 26 such that the door 28 is pivotable with respect to the frame 22 between the opened and closed positions. The hinges 30 can be fastened to the frame 22 and the door 28 with screws (not shown) or any of a variety of other suitable fasteners or coupling arrangements. It will be appreciated that a hinge or plurality of hinges pivotally couple the door 28 to the frame 22 in any of a variety of suitable manners as will be apparent to one of ordinary skill in the art. In one example, (not shown) the door 28 can be fastened with a hinge along the top of the frame 22 (e.g., at the top of each of the end pillars 26) such that door 28 pivots about a substantially horizontal axis and can be selectively opened by pulling up on the door 28. It will be appreciated that the door 28 can be coupled with the frame 22 with any of a variety of suitable alternative arrangements and in addition to or in lieu of hinges (e.g., 30). For example, the door 28 can be arranged to permit the door 28 to be selectively removed from bathtub insert 20. In another example, one of the frame 22 and the door 28 can include a groove and the other of the frame 22 and the door 28 can include a seal that is configured to engage the groove when the door 28 is in the closed position. The door 28 can be moved to the opened position by pulling the door 28 with enough force to disengage the seal from the groove.

Figure 3:
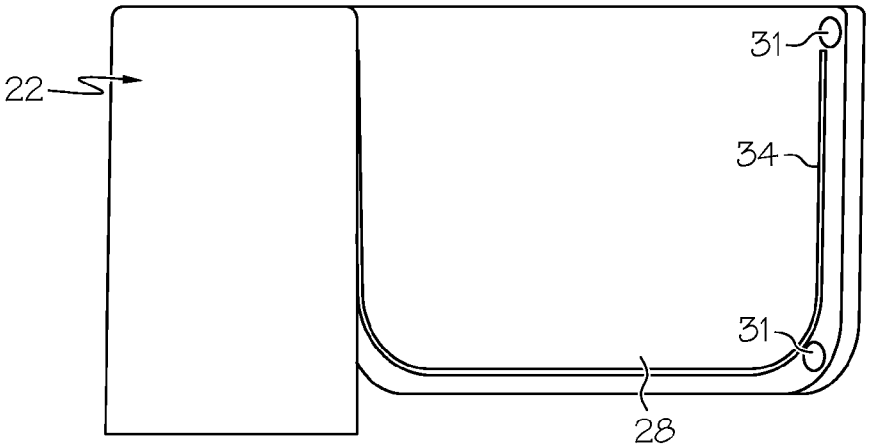
FIG. 3 is a side elevational view depicting the bathtub insert of FIG. 1, wherein the door is shown in a partially opened position.

In one embodiment, as illustrated in FIG. 3, the door 28 can include a pair of magnets 31 disposed along a non-hinged edge of the door 28. The frame 22 can include a pair of magnet plates (not shown) that respectively correspond with the magnets 31. The door 28 can be retained in the closed position by the magnetic coupling between the magnets 31 and the magnet plates and can be moved to the opened position by pulling the door 28 with enough force to overcome the magnetic coupling. The magnets 31 can retain the door 28 in the closed position with enough force to facilitate a watertight seal between the door 28 and the frame 22. It will be appreciated that additional magnets and magnet plates can be provided along the door 28 and/or frame 22 to facilitate effective retention of the door 28 in the closed position. It will also be appreciated that a plurality of magnets and magnet plates can be provided in lieu of hinges (e.g., 30) to allow the door 28 to be moved to the opened position by lifting it away from the frame 22.

Figure 2:
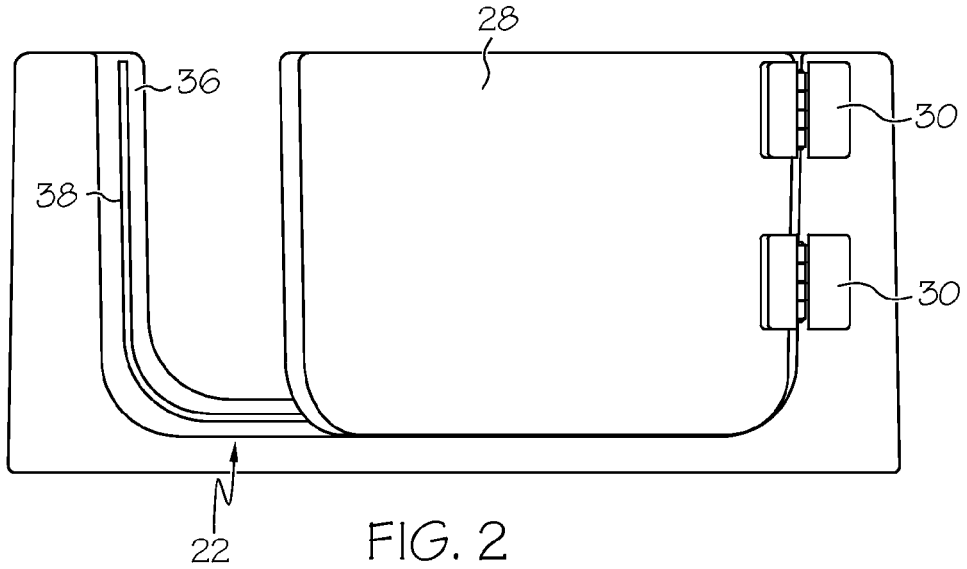
FIG. 2 is a front elevational view depicting the bathtub insert of FIG. 1, wherein the door is shown in a partially opened position.
Figure 4:
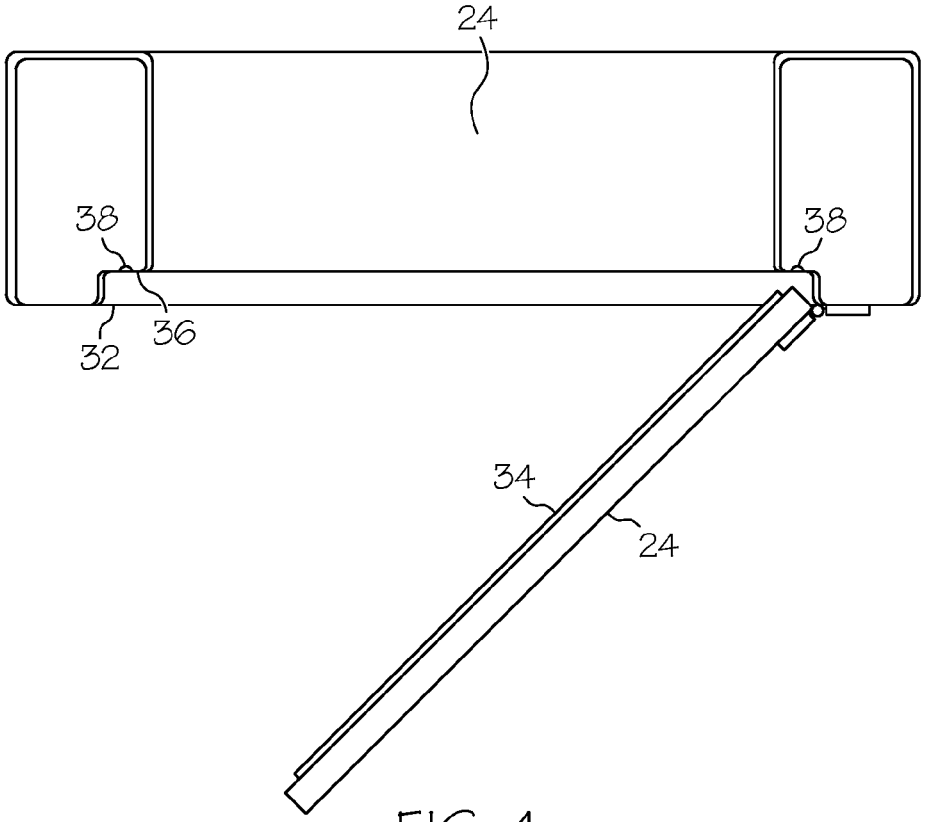
FIG. 4 is a top plan view depicting the bathtub insert of FIG. 1, wherein the door is shown in a partially opened position.

As illustrated in FIGS. 1, 2 and 4, the frame 22 can define a recess 32. The recess 32 can be dimensioned to receive the door 28 when the door 28 is in the closed position. The door 28 can accordingly be substantially flush with the frame 22 when in the closed position, thereby contributing to the overall aesthetics of the bathtub insert 20. As illustrated in FIGS. 3 and 4, the door 28 can include a seal 34 that is routed along the side and lower edges of the door 28. As illustrated in FIGS. 1, 2 and 4, an inner surface 36 of the recess 32 can define a channel 38 that is routed along the recess 32 and substantially conforms to the routing of the seal 34. When the door 28 is in the closed position, the seal 34 can be compressed tightly against the recess 32 and engaged with the channel 38 to provide a watertight seal. The seal 34 can comprise any suitable material as will be apparent to one of ordinary skill in the art. For example, the seal 34 can be made of a hydrophobic polymer. It will be appreciated that a seal and a corresponding channel can be positioned at any suitable location along a door and frame, respectively, and as will be apparent to one of ordinary skill in the art. It will also be appreciated than any suitable number of seals and/or channels can be provided to provide an effective watertight seal between the frame 22 and the door 28. For example, respective seals can be placed on the surface of the door 28 and the recess 32 such that the seals engage one another when the door 28 is in the closed position. The seals can be situated such that they are sandwiched together when the door 28 is in the closed position. Alternatively, the seals can be situated adjacent to each other when the door is in the closed position such that they compress against alternative surfaces. In addition, seal 34 can be magnetized such as by incorporating magnets into the seal 34.

Figure 5:
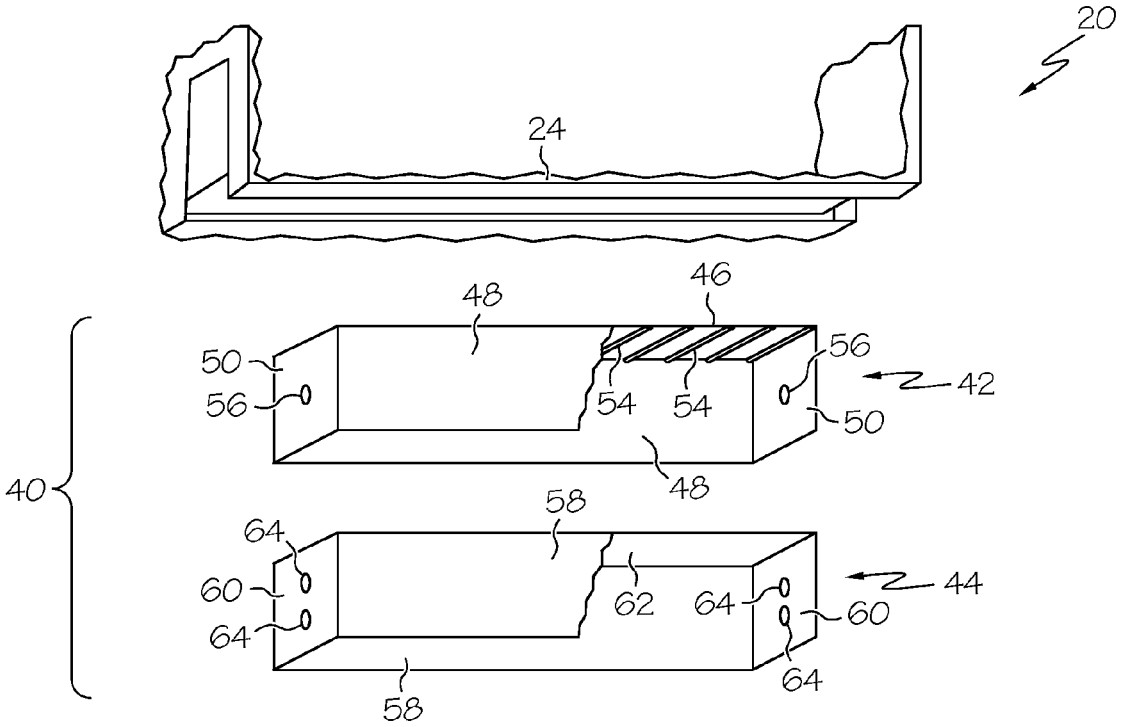
FIG. 5 is an exploded view depicting a step-plate and a support structure of the bathtub insert of FIG. 1.
Figure 6:
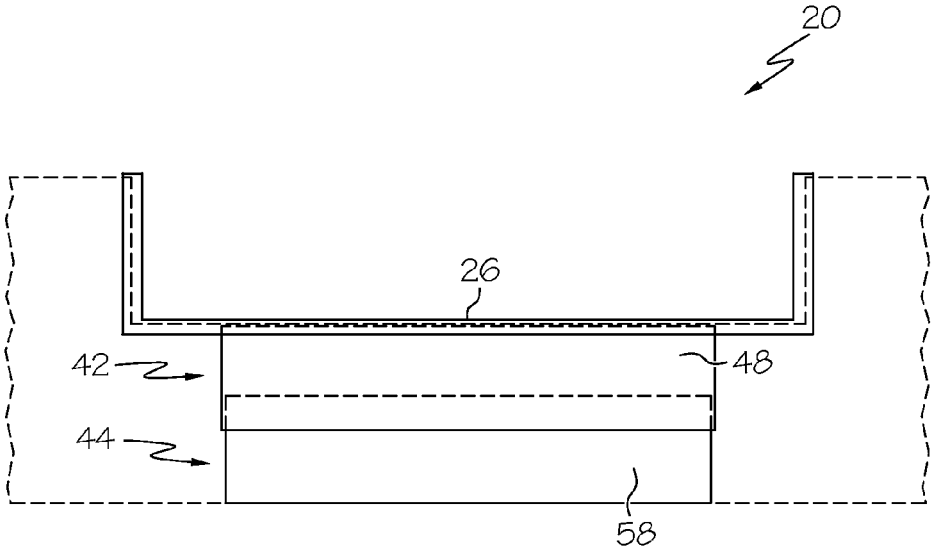
FIG. 6 is a fragmentary front elevational view depicting the step-plate and the support structure of the bathtub insert of FIG. 1.

As illustrated in FIGS. 5-6, a support structure 40 can be provided that facilitates effective installation of the bathtub insert 20 over the sidewall of the bathtub. The support structure 40 can comprise an adjustable housing 42 and a support housing 44. The adjustable housing 42 can be stacked upon the support housing 44 and can underlie the step-plate 24, as illustrated in FIG. 5. When the bathtub insert 20 is installed on the bathtub, the adjustable housing 42 and the support housing 44 can cooperate to provide underlying support for the bathtub insert 20 and more particularly, the step-plate 24. When a user steps upon the step-plate 24, the weight of the user can be at least partially borne by the support structure 40 thereby reducing the overall stress on the step-plate 24, the end pillars 26, and/or the bathtub sidewall.

In one embodiment, the adjustable housing 42 can be provided over the support housing 44 in a friction-type fit. Prior to installation of the bathtub insert 20, the overall height of the support structure 40 can be customized to the installation by sliding the adjustable housing 42 with respect to the support housing 44. Once an appropriate overall height is chosen for the support structure 40, the adjustable housing 42 can be secured in place with fasteners (e.g., a screw, a rod, a nut and bolt, a nail, a staple, a brad), an adhesive, a sealant, or in any of a variety of suitable manners as will be apparent to one of ordinary skill in the art.

Each of the adjustable housing 42 and the support housing 44 are shown to be rectangular shaped structures. The adjustable housing 42 can include a top panel 46, two side panels 48, and two end panels 50 that cooperate to define an open bottom. The upper panel 46 can contact the bottom of step-plate 24 and can be secured to the step-plate 24 with fasteners, adhesive, or the like. The adjustable housing 42 can be sized to fit into a channel (e.g., 52) defined beneath the step-plate 24. The upper panel 46 can include transverse ribs 54 that are incorporated or molded into the upper panel 46 and extend between the side panels 48. The transverse ribs 54 can aid in providing effective distribution of loading or weight over the adjustable housing 42 thereby reducing susceptibility to failure. The end panels 48 can define vent ports 56 that permit ventilation of an interior of the adjustable housing 42. When the adjustable housing 42 is slid with respect to the support housing 44 (e.g., to select an overall height of the support structure 40), the vent ports 56 can prevent any pressure (e.g., negative or positive) from forming within the interior of the adjustable housing 42 and resisting movement of the adjustable housing 42.

The support housing 44 can include a pair of side panels 58, a pair of end panels 60, and an upper panel 62. The side panels 58, end panels 60, and upper panel 62 can cooperate to define a receptacle 63. The support housing 44 can be configured for attachment of the adjustable housing 42 to a floor and/or the sidewall of the bathtub such as with fasteners (e.g., a screw, a rod, a nut and bolt, a nail, a staple, a brad), an adhesive, a sealant (e.g., an elastomeric sealant), or in any of a variety of other suitable manners as will be apparent to one of ordinary skill in the art. In one example, a support member, such as a piece of lumber (e.g., 2×4), can be secured to a floor of the bathroom and within the bathtub opening. The support housing 44 can be fit overtop of the support member and attached with fasteners and/or adhesive.

Each of the end panels 60 can define additional vent ports 64. The additional vent ports 64 can selectively communicate with the vent ports 56 of the adjustable support 42 to permit air flow in order to prevent negative or positive pressure from forming between the adjustable housing 42 and the support housing 44. It will be appreciated that the adjustable housing 42 and the support housing 44 can be configured from wood, polymer, plastic, ceramic, metal, or any other suitable material.

In an alternative embodiment, support bracing (not shown) for the bathtub insert 20 can be affixed to or otherwise mounted directly on a bathtub in addition to or in lieu of the support structure 40. For example, support bracing can be affixed to the sidewall of the bathtub. The support bracing can be affixed to the bathtub in any suitable manner as will be apparent to one of ordinary skill in the art, such as with adhesive or fasteners. The support bracing can also be made of any suitable material, such as metal reinforced members. In one embodiment, the support bracing can have an expandable width, height and/or depth to fit the dimensions of a particular installation (e.g., the dimensions of a bathtub and/or cutout portion of the bathtub). For example, the support bracing can extend from the underside of step-plate 24 to the floor and/or sidewall of the bathtub in a telescoping configuration. The support bracing can have pre-set holes into which tangs from a corresponding brace member fit in order to correctly size the support structure for a particular installation. In another embodiment, the support bracing can be built into the underside of the step-plate 24 such that the support bracing is integral with the step-plate 24 (e.g., one-piece construction).

Figure 7:
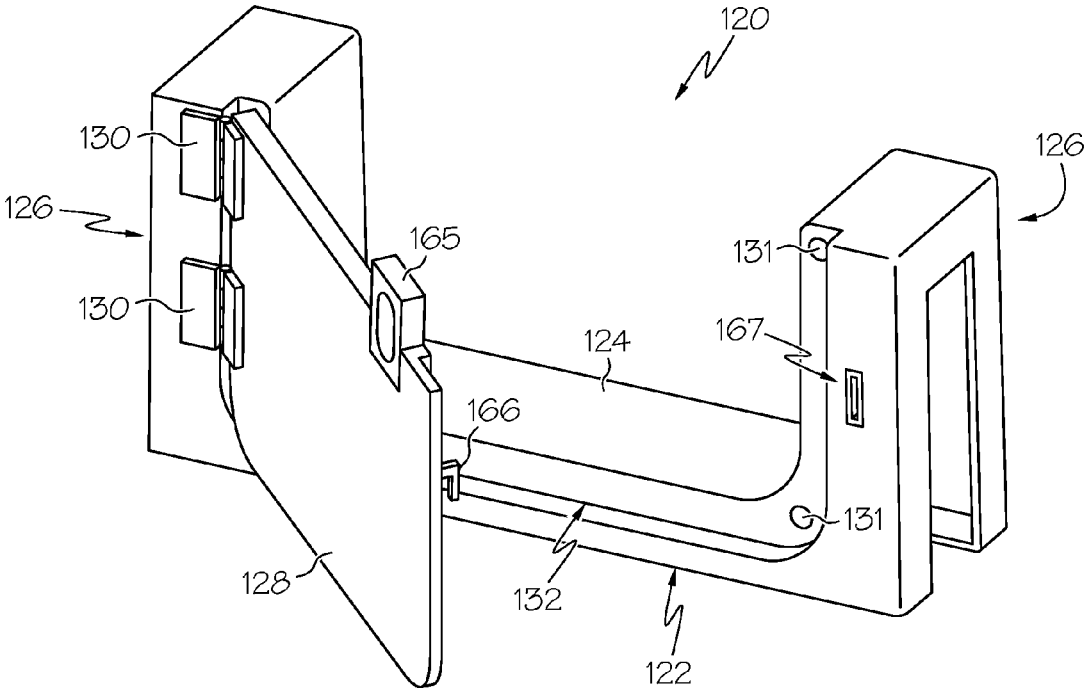
FIG. 7 is a front perspective view depicting a bathtub insert according to another embodiment, wherein a door is shown in a partially opened position.

FIG. 7 illustrates a bathtub insert 120 according to another embodiment. The bathtub insert 120 can be similar in many respects to the bathtub insert 20 shown in FIGS. 1-4. For example, the bathtub insert 120 can include a frame 122 having a step-plate 124 and a pair of end pillars 126. The bathtub insert 120 can also comprise a door 128 that is pivotally coupled to the frame 122 with hinges 130. The frame 122 can define a recess 132. A pair of magnets 131 can be disposed along the recess 132 to interact with magnet plates (not shown) mounted on a non-hinged portion of the door 128. However, the bathtub insert 120 can include a handle 165 that is disposed along an upper portion of the door 128. The handle 165 can be grasped by a user to facilitate manual movement of the door 128 between opened and closed positions. The handle 165 can be attached to the door 128 with fasteners, such as screws and/or bolts, for example, or the handle 165 can alternatively be formed with the door 128 as a one-piece construction.

The bathtub insert 120 can include a latch assembly having a latch 166 and a receiver 167. The receiver 167 can be configured to selectively engage the latch 166 to facilitate retention of the door 128 in the closed position. The latch 166 can be coupled with the door 128 and can extend outwardly and generally perpendicularly from the door 128. The receiver 167 can be disposed along one of the end pillars 126 and adjacent to the recess 132. In one embodiment, the receiver 167 can comprise a push-to-latch arrangement, such as a double-roller catch, for example. In such an embodiment, when the door 128 is moved to the closed position, the receiver 167 can grasp the latch 166 to retain the door 128 in the closed position. The door 128 can be opened by pulling the door 128 away from the frame 122 until the force of the receiver 167 on the latch 166 is overcome. In another embodiment, the receiver 167 can comprise a push-to-latch, push-to-unlatch arrangement (e.g., manual or electronic). In such an embodiment, when the door 128 is moved to the closed position, the receiver 167 can grasp the latch 166 to retain the door 128 in the closed position. The door 128 can be opened by pushing the door 128 inwards towards the frame 122 which causes the receiver 167 to release the latch 166. In another embodiment, the receiver 167 can comprise an electronic grabber-type latch. In such an embodiment, when the door 128 is moved to the closed position, a grabbing member (not shown) can automatically grasp the latch 166 to retain the door 128 in the closed position. The door 128 can be opened by actuating the receiver 167 to release the latch 166, such as with a pushbutton or remote control, for example. It will be appreciated that a latch and/or receiver can be any of a variety of suitable alternative arrangements that facilitate selective retention of a door in a closed position. In one example, the latch can be coupled to the frame and the receiver can be coupled to the door.

Figure 8:
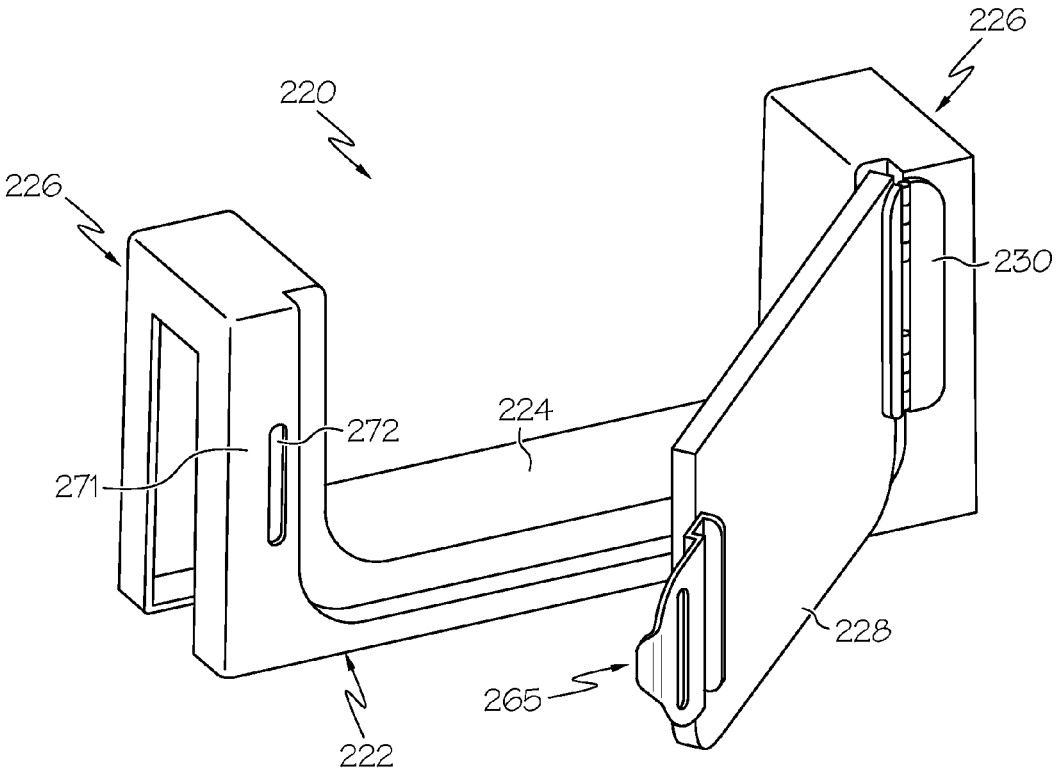
FIG. 8 is a front perspective view depicting a bathtub insert according to yet another embodiment, wherein the door is shown in a partially opened position.
Figure 9:
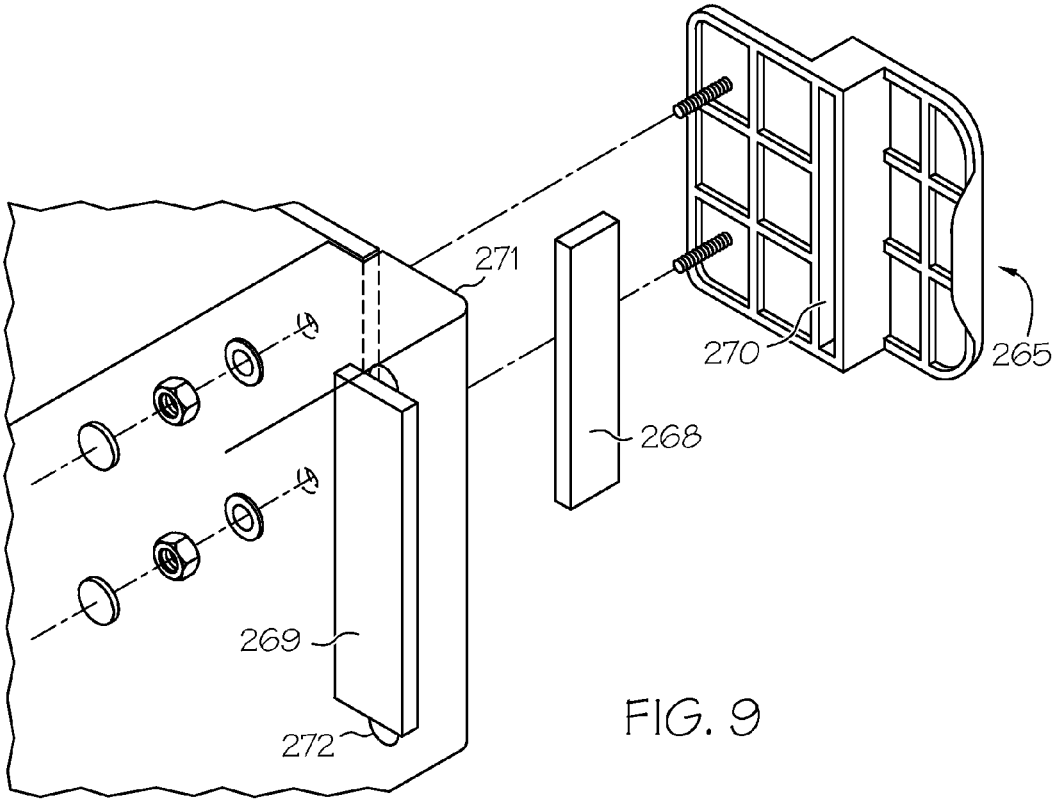
FIG. 9 is an exploded view of a handle, a latch assembly, and a portion of an end pillar of the bathtub insert of FIG. 8.

FIGS. 8-9 illustrate a bathtub insert 220 according to another embodiment. The bathtub insert 220 can be similar in many respects to the bathtub insert 120 shown in FIG. 7. For example, the bathtub insert 220 can include a frame 222 having a step-plate 224 and a pair of end pillars 226. The bathtub insert 222 can also comprise a door 228 that can be pivotally coupled to the frame 222 with a hinge 230. However, a handle 265 can be disposed along an outer edge and between upper and lower edges of the door 228. The handle 265 is shown in FIG. 9 to be bolted to the door 228 but can additionally or alternatively be coupled with the door 228 in any of a variety of other suitable alternative arrangements. As illustrated in FIG. 9, a latch assembly can include a magnet 268 and a magnet plate 269. The magnet 268 can be disposed within an elongated receptacle 270 defined by the handle 265 and coupled to the handle 265 in a friction fit, with fasteners, with adhesive, or in any of a variety of suitable alternative arrangements. The magnet plate 269 can be secured to a wall 271 and along an interior of one of the end pillars 226. The magnet plate 269 can be secured to the wall 271 with fasteners, adhesive, or with any of a variety of other suitable alternative coupling arrangements. In one embodiment, a magnet plate can comprise another magnet.

When the door 228 is in the closed position, the magnetic coupling between the magnet 268 and the magnet plate 269 can hold the door 228 closed. The door 228 can be opened by pulling the handle 265 until the magnetic coupling between the magnet 268 and the magnet plate 269 is overcome. In one embodiment, as illustrated in FIGS. 8-9, the wall 271 can define an elongated aperture 272 adjacent to the magnetic plate 269. When the door 228 is in the closed position, the magnet 268 can extend into the elongated aperture 272 and into contact with the magnet plate 269.

Figure 10:
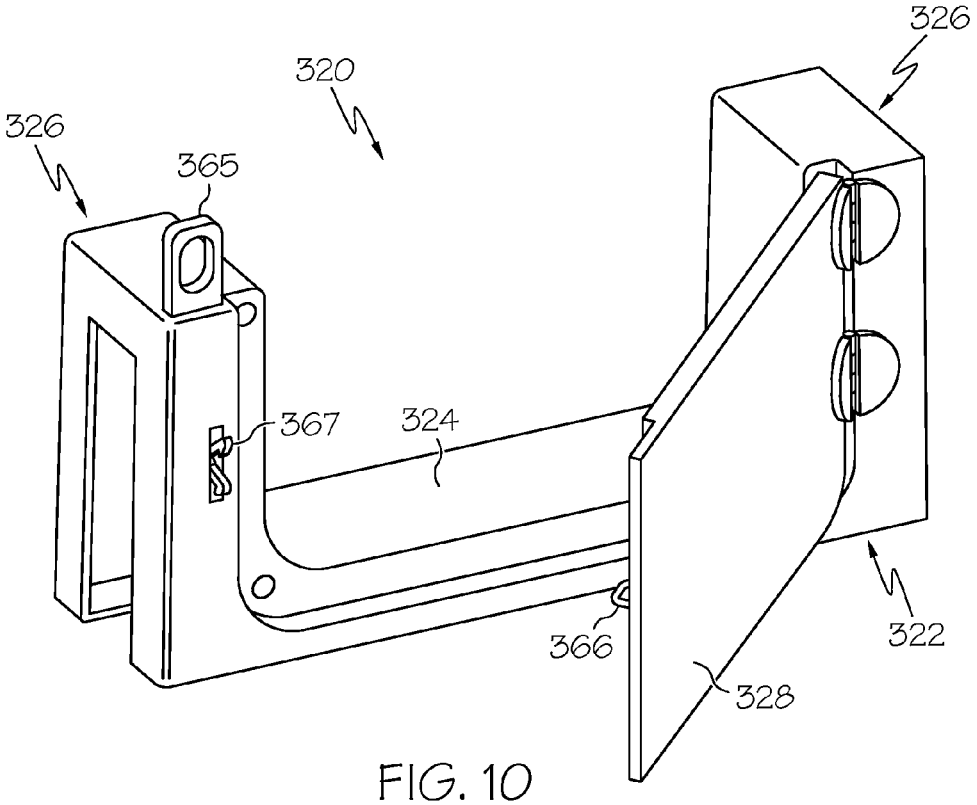
FIG. 10 is a front perspective view depicting a bathtub insert according to yet another embodiment, wherein a door is shown in a partially opened position.

FIG. 10 illustrates a bathtub insert 320 according to another embodiment. The bathtub insert 320 can be similar in many respects to the bathtub insert 120 shown in FIG. 7. For example, the bathtub insert 320 can include a frame 322 having a step-plate 324 and a pair of end pillars 326. The bathtub insert 322 can also comprise a door 328 that is pivotally coupled to the frame 322 with a hinge 330. However, the bathtub insert 320 can include a latch assembly having a ring latch 366 and a receiver 367. The receiver 367 can comprise a rotary latch that selectively grasps the ring latch 366. When the door 328 is moved to the closed position, the rotary latch can grasp the ring latch 366 to retain the door 328 in the closed position. To facilitate opening of the door 328 from the closed position, a handle 365 can be pulled upwardly (e.g., actuated) to actuate the rotary latch to release the ring latch 366. Any of suitable alternative latch arrangements are contemplated, such as a pin for example. It will be appreciated that the receiver 367 can comprise any of a variety of suitable alternative rotary latch arrangements that facilitate selective retention of a door in a closed position.

Figure 11:
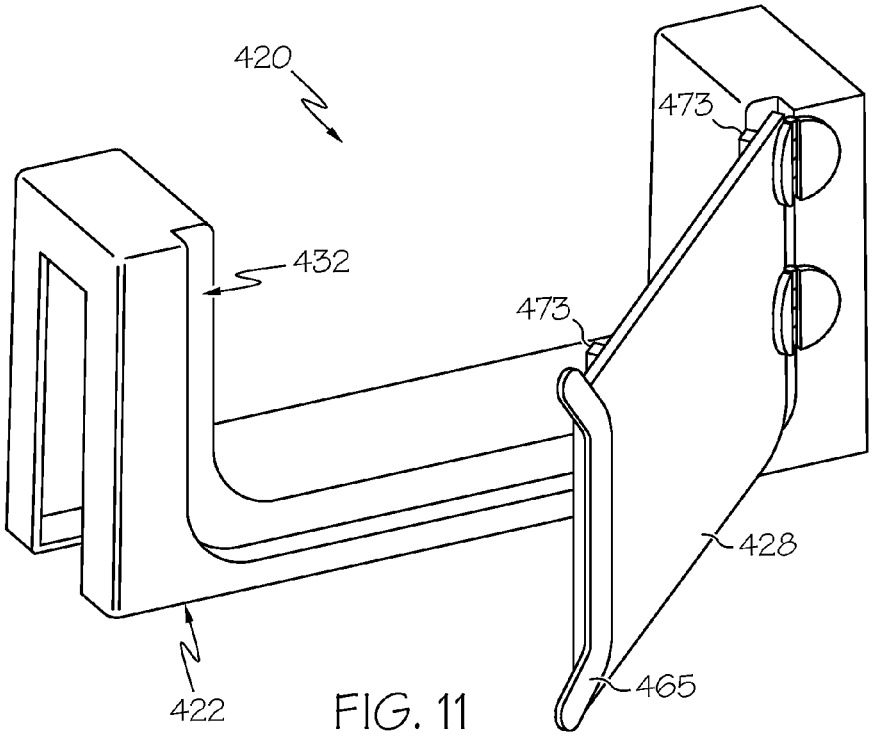
FIG. 11 is a front perspective view depicting a bathtub insert according to yet another embodiment, wherein a door is shown in a partially opened position.

FIG. 11 illustrates a bathtub insert 420 according to another embodiment. The bathtub insert 420 can be similar in many respects to the bathtub insert 120 shown in FIG. 7. For example, the bathtub insert 420 can include a frame 422 and a door 428. The frame 422 can define a recess 432. However, a handle 465 can be disposed along an outer edge of the door 428. The handle 465 can be attached to the door 428 with fasteners, such as screws and/or bolts, for example, or the handle 465 can alternatively be formed with the door 428 as a one-piece construction. In one embodiment, the handle 465 can be formed from stainless steel, but in other embodiments, the handle 465 can be formed from any of a variety of other suitable alternative materials.

A magnetic seal 473 can be coupled with the door 428. When the door 428 is in the closed position, the magnetic seal 473 can be magnetically coupled with a magnet plate (not shown) disposed behind the recess 432. The magnetic coupling between the magnetic seal 473 and the magnet plate can hold the door 428 in the closed position and can hold the door 428 with enough force to provide a watertight seal between the door 428 and the frame 422. The door 428 can be opened by pulling the door 428 towards the opened position (e.g., with the handle 465) with enough force to overcome the magnetic coupling. In one embodiment, the magnet plate can be routed substantially entirely (e.g., substantially entirely or entirely) along the recess 432. In such an embodiment, the magnetic seal 473 can be routed along the door 428 to form a U-shape that corresponds to the location of the magnet plate. It will be appreciated that any magnetic seal and/or magnet plate arrangement is contemplated.

FIGS. 12-19 illustrate a bathtub insert 520 according to another embodiment. The bathtub insert 520 can be similar in many respects to the bathtub insert 20 shown in FIGS. 1-6. For example, the bathtub insert 520 can include a frame 522 having a step-plate 524 and a pair of end pillars 526. The bathtub insert 520 can also comprise a door 528 that is pivotally coupled to the frame 522 with hinges 530. The door 528 can include a pair of magnets 531 disposed along a non-hinged edge of the door 528. The door 528 can include a seal 534 that is routed along the interior of the door 528. However, the bathtub insert 520 can include a handle assembly that facilitates selective locking of the door 528 in the closed position. The handle assembly can include a latch 566 and a receiver. The receiver can include an upper strike plate 575 and a lower strike plate 576. The latch 566 can include an upper arm portion 577 and a lower arm portion 578.

Figure 19:
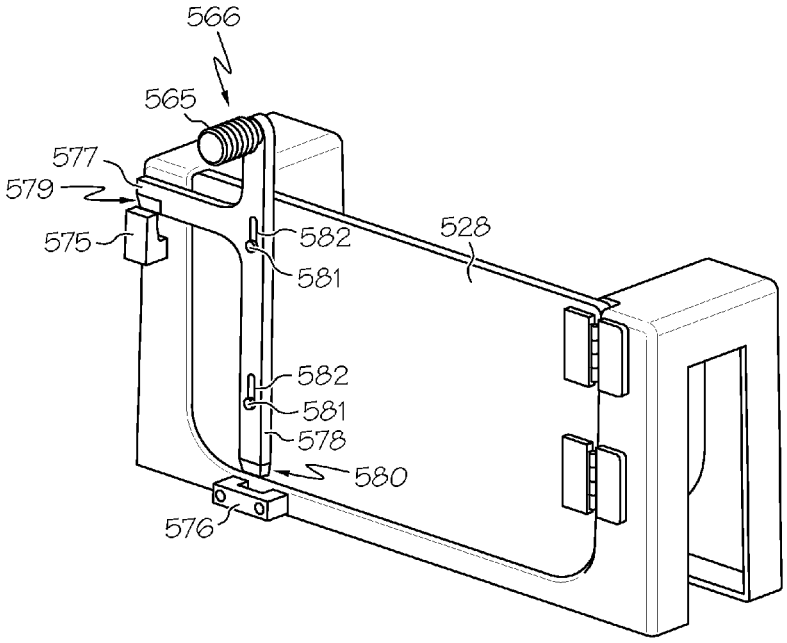
FIG. 19 is a side perspective view depicting the bathtub insert of FIG. 12 with the door shown in a closed position.

The latch 566 can be slideable with respect to the door 528 between a latched position (not shown) and an unlatched position (FIGS. 12-19). When the latch 566 is in the latched position with the door 528 in the closed position, as illustrated in FIG. 19, the upper and lower arm portions 577, 578 can extend into the respective upper and lower strike plates 575, 576 to facilitate locking of the door 528. When the latch 566 is moved to the unlatched position, the upper and lower arm portions 577, 578 can be withdrawn from the respective upper and lower strike plates 575, 576 such that the door 528 is free to pivot between the open and closed positions.

The upper and lower strike plates 575, 576 can be secured to frame 522 in any suitable manner as will be apparent to one of ordinary skill in the art. For example, the upper and lower strike plates 575, 576 can be screwed into the frame 522. In another example, the upper and lower strike plates 575, 576 can be formed with the frame 522 as a one-piece construction.

The upper and lower arm portions 577, 578 are shown to define respective tapered portions 579, 580. If the door 528 is slightly ajar when the latch 566 is moved to the latched position, the tapered portions 579, 580 can interact with the upper and lower strike plates 575, 576, respectively, to urge the door 528 into the closed position. In one embodiment, urging the door 528 into the closed position can compress the seal 534 to provide a watertight seal between the frame 522 and the door 528.

Figure 12:
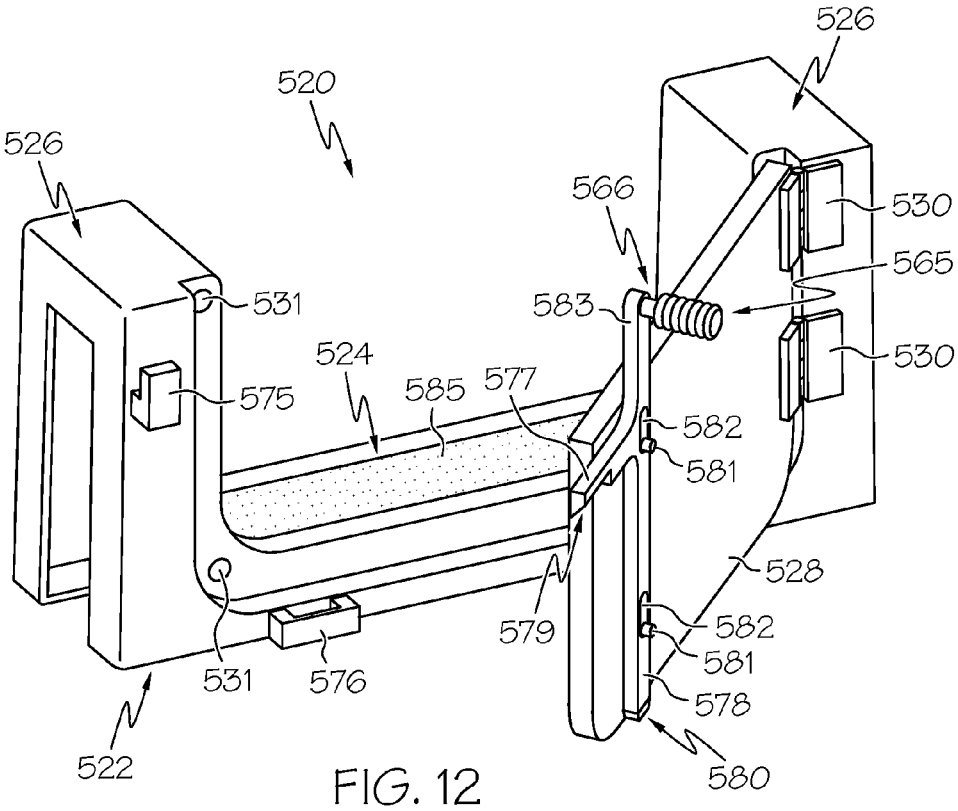
FIG. 12 is a front perspective view depicting a bathtub insert including a door according to still another embodiment, wherein the door is shown in a partially opened position.

The latch 566 can be slideably coupled to the door 528. In one embodiment, the latch 566 can be slid substantially vertically between the latched and unlatched positions. Movement of the latch 566 between the latched and unlatched positions can facilitate corresponding, simultaneous movement of the upper and lower arm portions 579, 580. As illustrated in FIG. 12, the latch 566 can be coupled to the door 528 with a pair of tabs 581. The tabs 581 can project through respective slotted apertures 582 defined by the lower arm portion 578. The tabs 581 can be configured to slide freely within the slotted apertures 582 to facilitate movement of the latch 566 between the latched and unlatched positions. The slotted apertures 582 are shown to be arranged to facilitate substantially vertical movement of the latch 566. In an alternative arrangement, the slotted apertures 582 can be substantially L-shaped. In such an arrangement, the latch 566 can be moved vertically into the unlatched position and then moved horizontally to temporarily hold the latch 566 in the unlatched position. It will be appreciated that a latch can comprise any of a variety of suitable alternative arrangements to facilitate selective locking of the door 528. For example, a latch can be configured to move horizontally between the latched and unlatched positions.

The latch 566 can include a handle 566 that can be grasped by a user to facilitate manual movement of the latch 566. The handle 566 is shown to extend from an upper portion 583 of the latch 566. The handle 566 can be coupled to the upper portion 583 with fasteners, such as a screw or a bolt, or any of a variety of suitable alternative arrangements. It will be appreciated that a latch can operated using any of a variety of manual or automated actuators, such as with a pushbutton, for example.

Figure 13:
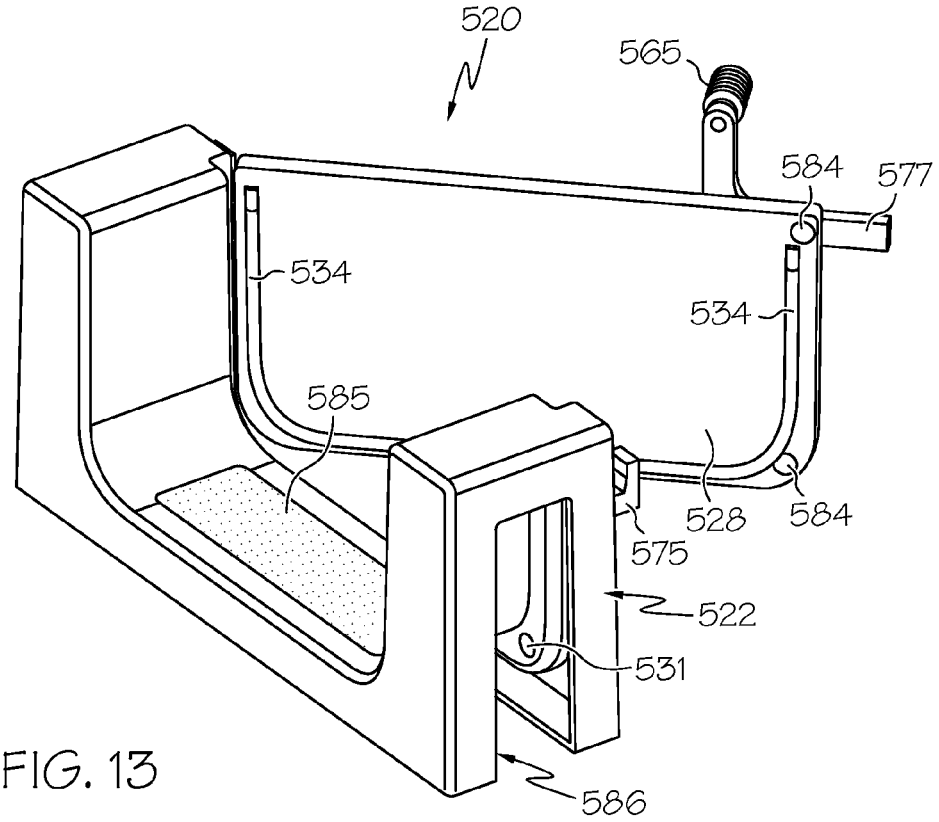
FIG. 13 is a rear perspective view depicting the bathtub insert of FIG. 12, wherein the door is shown in a partially opened position.
Figure 14:
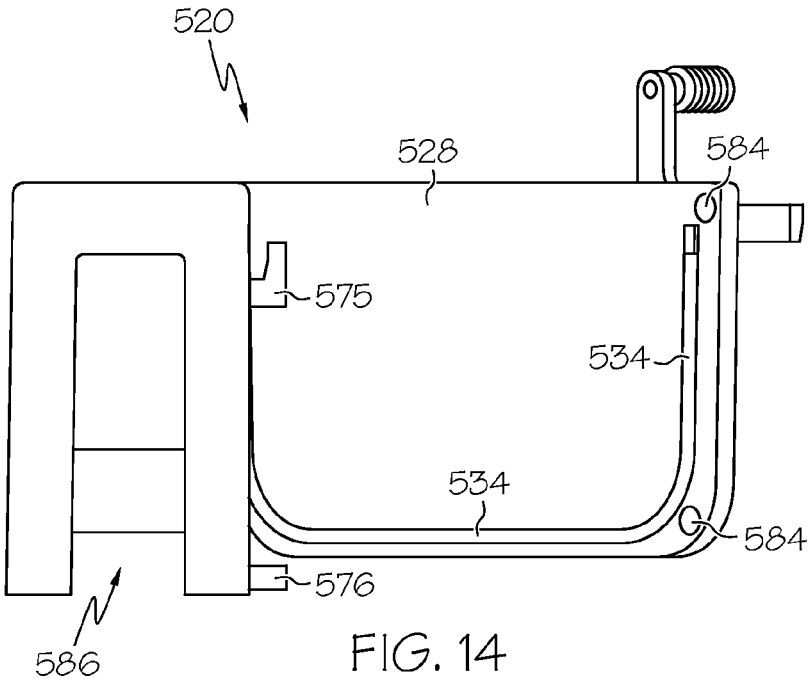
FIG. 14 is a side elevational view depicting the bathtub insert of FIG. 12, wherein the door is shown in a partially opened position.
Figure 15:
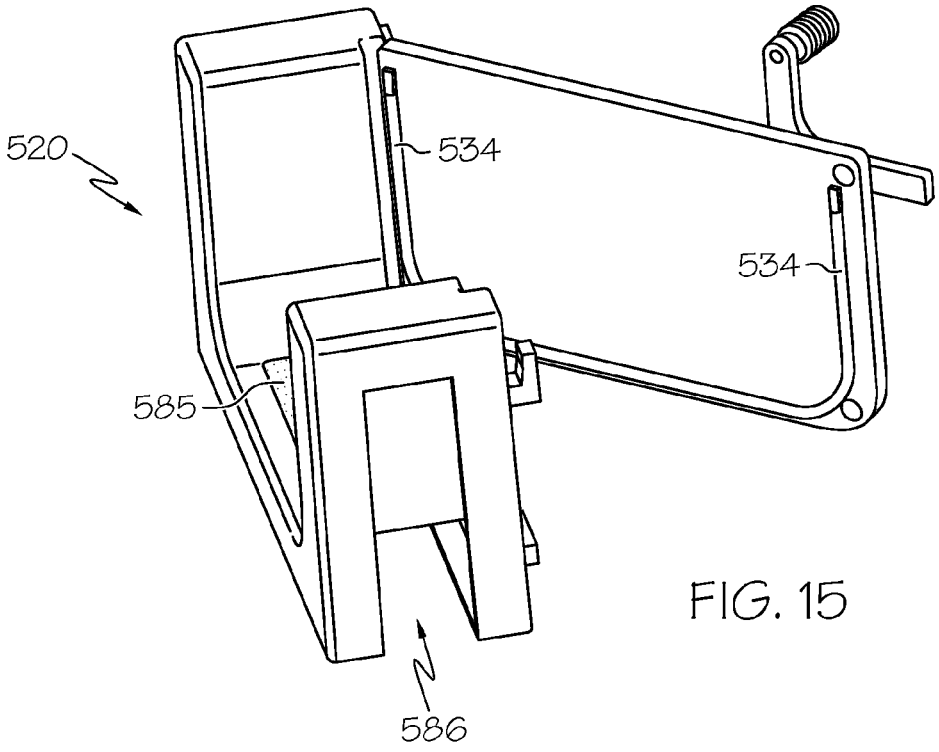
FIG. 15 is a side perspective view depicting the bathtub insert of FIG. 12, wherein the door is shown in a partially opened position.
Figure 16:
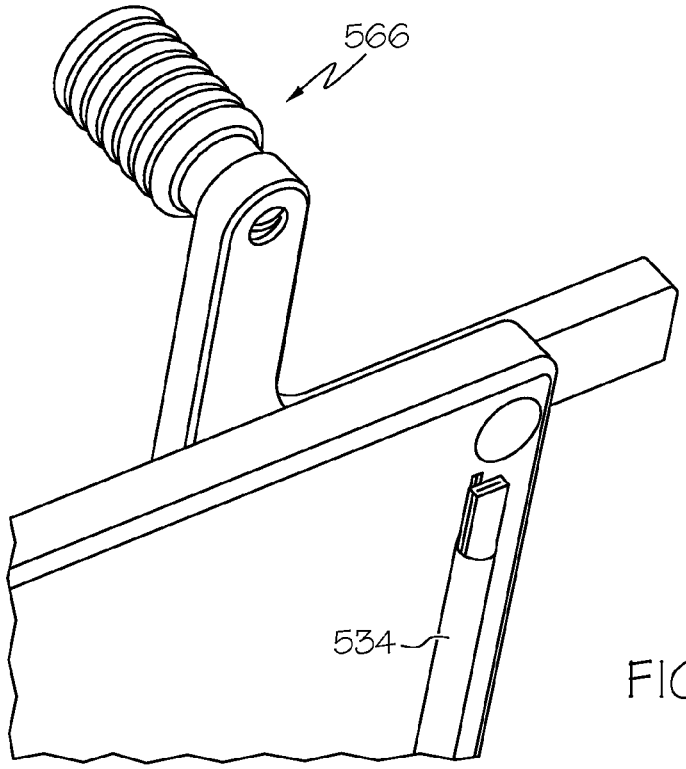
FIG. 16 is an enlarged view depicting a latch of the bathtub insert of FIG. 12.
Figure 17:
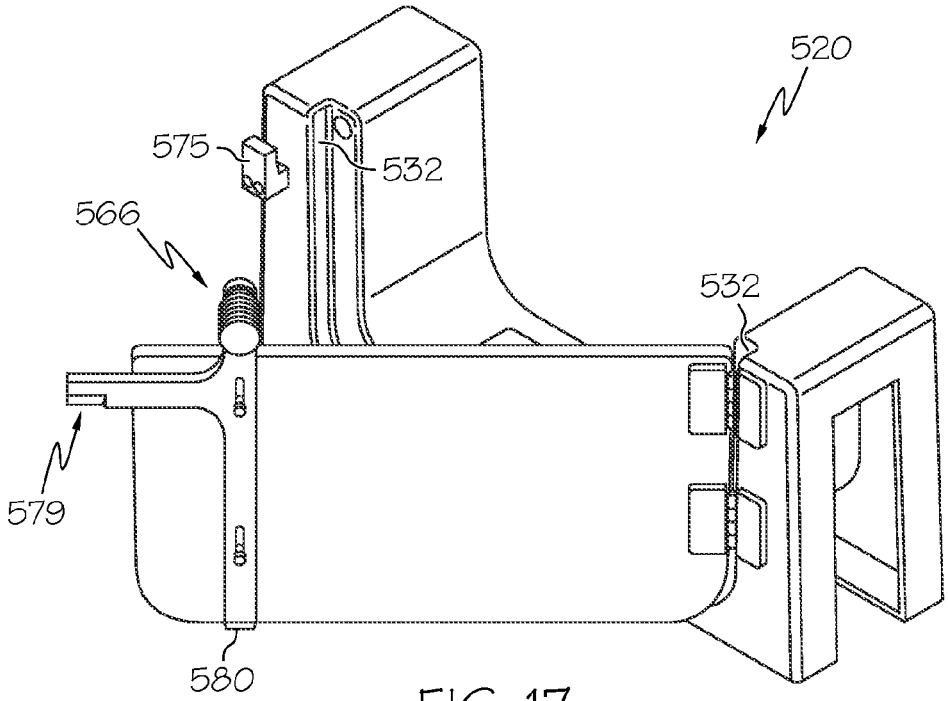
FIG. 17 is a side perspective view depicting the bathtub insert of FIG. 12, wherein the door is shown in a partially opened position.
Figure 18:
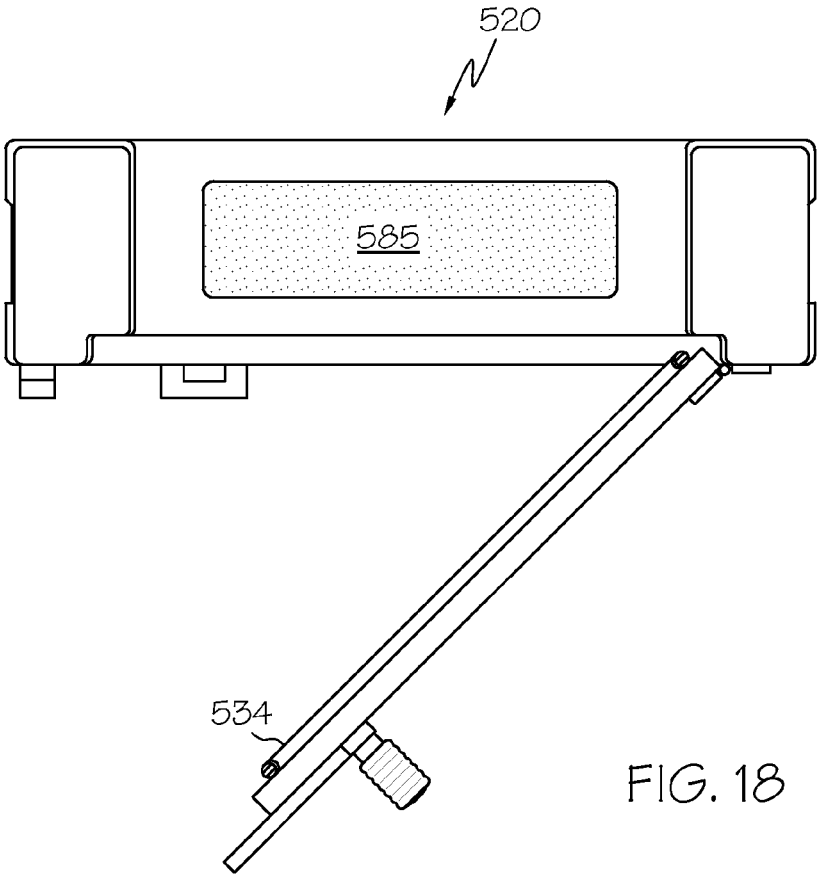
FIG. 18 is a top plan view depicting the bathtub insert of FIG. 12, wherein the door is shown in a partially opened position.

The bathtub insert 520 can include strike plates 584 that are arranged along the door 528 to correspond with the magnets 531. When the door 528 is moved to the closed position, the magnets 531 can be magnetically coupled to the strike plates 584 to temporarily hold the door 528 in place while the latch 566 is being moved into the latched position. In one embodiment, the strike plates 584 can be exposed to the magnets 531, as illustrated in FIGS. 13-14, but in an alternative embodiment, the strike plates 584 can be concealed within the interior of the frame 522.

As illustrated in FIGS. 12, 13, 15, and 18, a tread portion 585 can be coupled to or fashioned as part of the step-plate 524. The tread portion 585 can serve to provide traction and/or the coefficient of friction of the step-plate 524. In this way, the tread portion 585 can help prevent a user from slipping and/or falling while stepping on the frame 522. The tread portion 585 can comprise any suitable material such as, for example, fabric, an absorbent material, an aesthetically pleasing material, a removable material, a material with a high coefficient of friction, or the like. The tread portion 585 can be applied or fabricated as part of step-plate 524 in any of a variety of suitable manners, such as, by integrally molding the tread portion 585 with the step-plate 524, and/or through gluing or stapling. The tread portion 585 can be permanently affixed to step-plate 524 or removable. The surface of the tread portion 585 can be provided with any suitable finish as will be apparent to one of ordinary skill in the art, such as for example, an etched surface.

The frame 522 is shown to define a cavity 586 that extends beneath the step-plate 524 and between the end pillars 526. The cavity 586 can provide for effective installation of the bathtub insert 520 over an underlying portion of the sidewall of the bathtub. It will be appreciated that the frame 522 can be any of a variety of arrangements such as being provided with a solid bottom.

Figure 20:
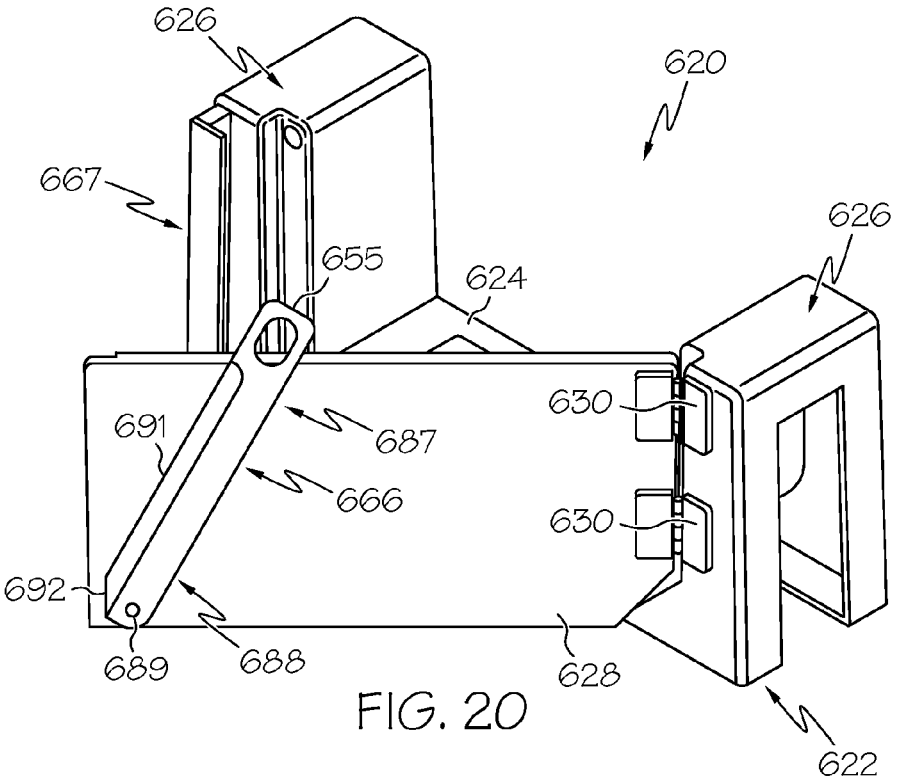
FIG. 20 is a front perspective view depicting a bathtub insert according to still another embodiment with a door shown in an opened position and a latch according to one embodiment and shown in an unlatched position.
Figure 21:
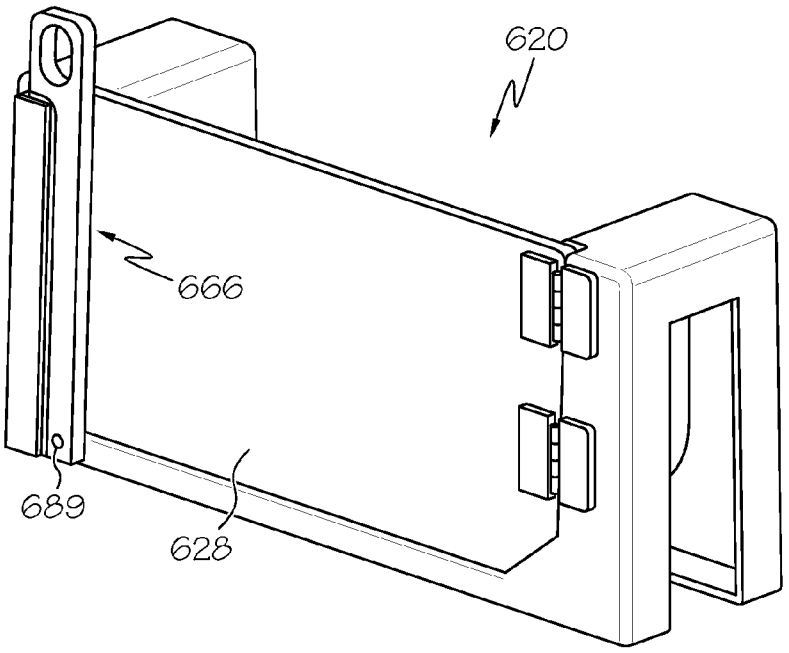
FIG. 21 is a side perspective view depicting the bathtub insert of FIG. 20 with the door shown in a closed position and the latch shown in a latched position.
Figure 22:
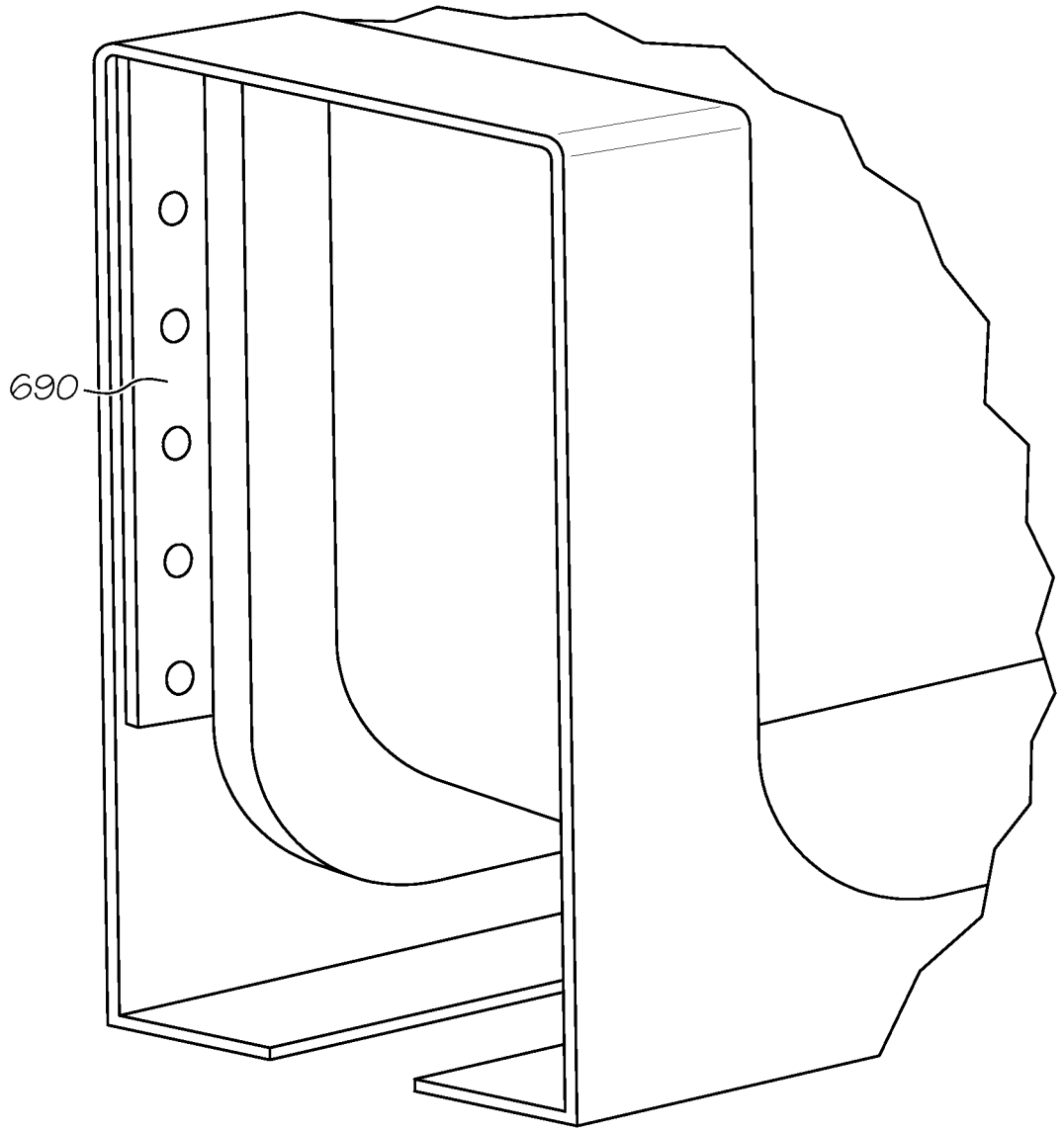
FIG. 22 is an enlarged perspective view depicting a back plate of the bathtub insert of FIG. 20.

FIGS. 20-23 illustrate a bathtub insert 620 according to another embodiment. The bathtub insert 620 can be similar in many respects to the bathtub insert 20 shown in FIGS. 1-6. For example, the bathtub insert 620 can include a frame 622 having a step-plate 624 and a pair of end pillars 626. The bathtub insert 620 can also comprise a door 628 that is pivotally coupled to the frame 622 with hinges 630. However, the bathtub insert 620 can include a latch 666 that can be an elongate member having a first end 687 and a second end 688. The first end 687 can be pivotally coupled to the door 628, such as with a pin 689 or other pivotal coupling arrangement. A catch 667 can be coupled with the end pillar 626 adjacent to the non-hinged edge of the door 628. To lock the door 628 in the closed position, the latch 666 can be pivoted into a latched position and into engagement with the catch 667, as illustrated in FIG. 20. To unlock the door 628, the latch 666 can be moved into an unlatched position and out of engagement with the catch 667, as illustrated in FIG. 21.

In FIGS. 20-21, the catch 667 is shown to comprise an L-channel member that is coupled to one of the end pillars 626 and extends substantially vertically along the end pillar 626. The catch 667 can be coupled to the end pillar 626 with fasteners or adhesive, formed with the end pillar 626 as a one-piece construction, and/or coupled to the end pillar 626 in any of a variety of suitable alternative arrangements. The hinges 630 can be coupled to a back plate 690 (FIG. 22) that is disposed within an interior of the frame 622.

The latch 666 can include a tapered portion 691 that extends between the first and second ends 687, 688 of the latch 666. When the latch 666 is moved into the latched position, the tapered portion 691 can cooperate with the catch 667 to urge the door 628 into the closed position. In one embodiment, urging the door 628 into the closed position can compress a seal (e.g., 34, 134) to provide a watertight seal between the frame 622 and the door 628.

Figure 23:
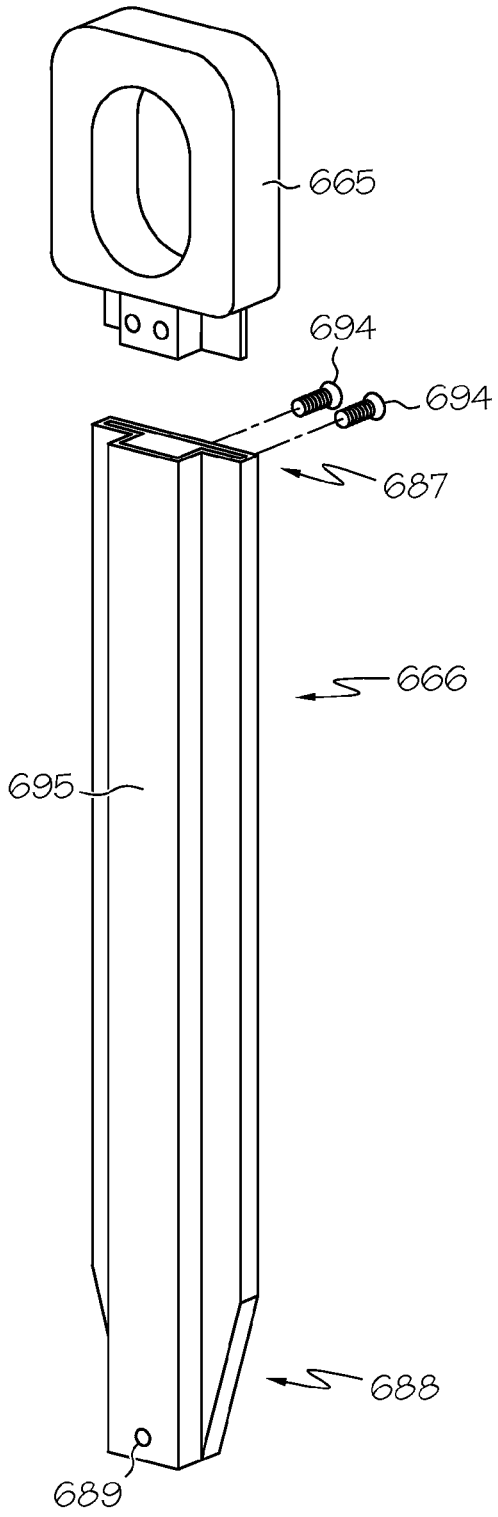
FIG. 23 is an exploded view of a latch of the bathtub insert of FIG. 20 according to another embodiment.

As illustrated in FIG. 20, the tapered portion 691 can include a lower edge 692 that extends at an oblique angle such that the second end 688 of the latch 666 is narrower than the rest of the latch 666. When the latch 666 is moved to the unlatched position, the lower edge 692 can be angled such that the latch 666 is spaced from the catch 667 and allows the door 628 to be moved into the opened position. The latch 666 can include a handle 665 that can be grasped by a user to facilitate manual movement of the latch 666 between the latched and unlatched positions. The handle 665 can be disposed at the first end 687 of the latch 666 such that the handle 665 can be readily grasped by a user. In one embodiment, as illustrated in FIGS. 20-21, the handle 665 can be formed together with the lower portion 667 as a one-piece construction. In another embodiment, as illustrated in FIG. 23, the handle 665 can be separate from the first end 687 of the latch 666 and secured to the first end 687 with screws 694 or any of a variety of suitable alternative securing arrangements. In such an embodiment, the latch 666 might not include any tapered portions (e.g., 691) but can include a thicker central portion 695 that can provide the latch 666 with a certain symmetric appearance. Although the handle 665 is described as being configured to facilitate manual actuation of the latch 666, it will be appreciated that the latch 666 can be actuated with any of a variety of suitable alternative manual or automated arrangements, such as with a pushbutton, for example.

Figure 24:
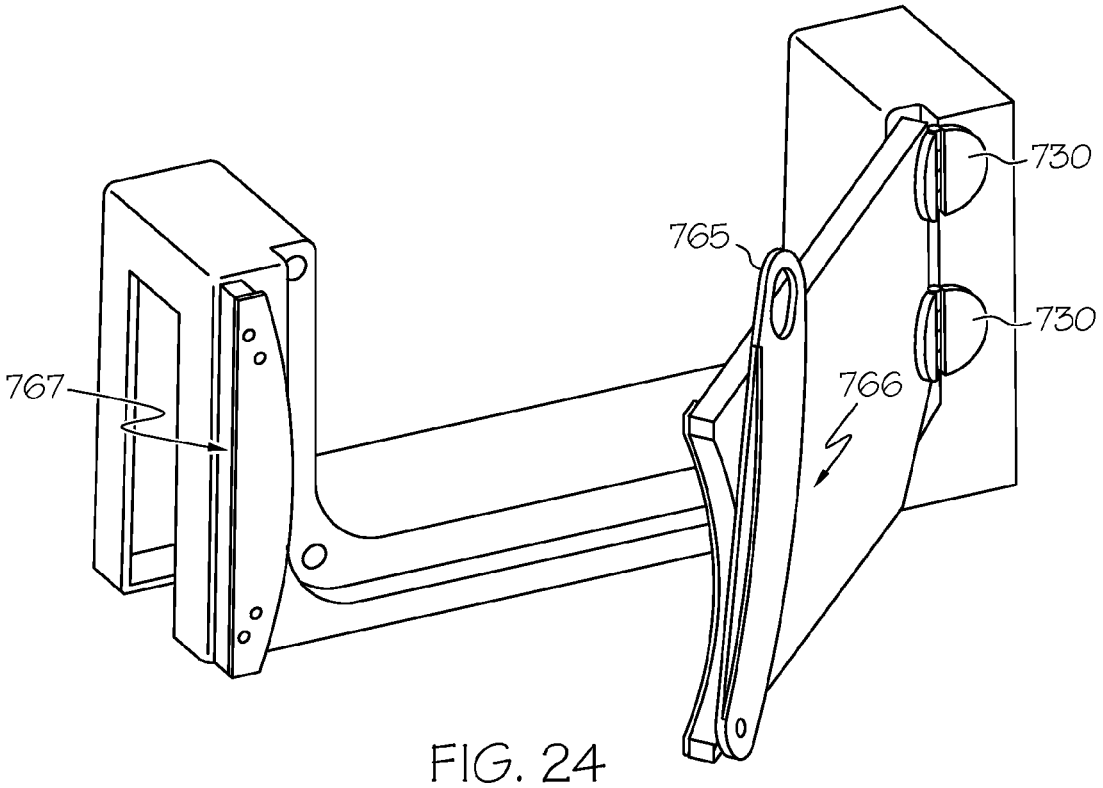
FIG. 24 is a front perspective view depicting a bathtub insert according to still another embodiment with a door shown in an opened position and a latch shown in an unlatched position.
Figure 25:
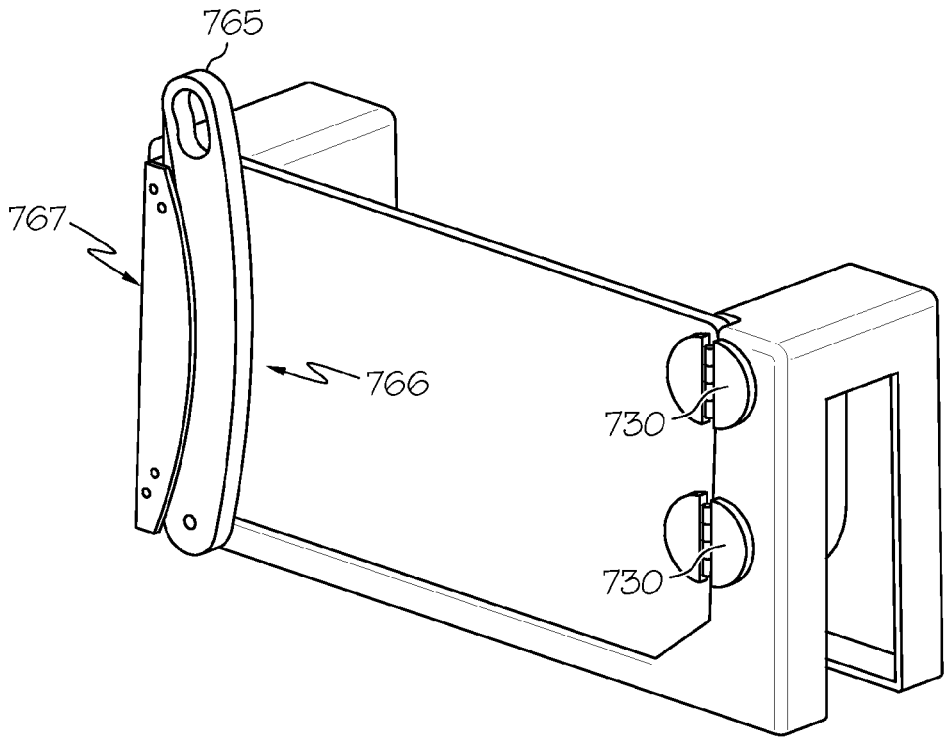
FIG. 25 is a front perspective view depicting the bathtub insert of FIG. 24 with the door shown in a closed position and the latch shown in a latched position.

FIGS. 24-25 illustrate a bathtub insert 720 according to another embodiment. The bathtub insert 720 can be similar in many respects to the bathtub insert 620 shown in FIGS. 20-23. However, the bathtub insert 720 can include a latch 766 and a catch 767 that have a contoured profile that can provide certain aesthetics for the bathtub insert 720. Hinges 730 can be configured to have a more rounded overall shape which can also provide certain aesthetics for the bathtub insert 720.

Figure 26:
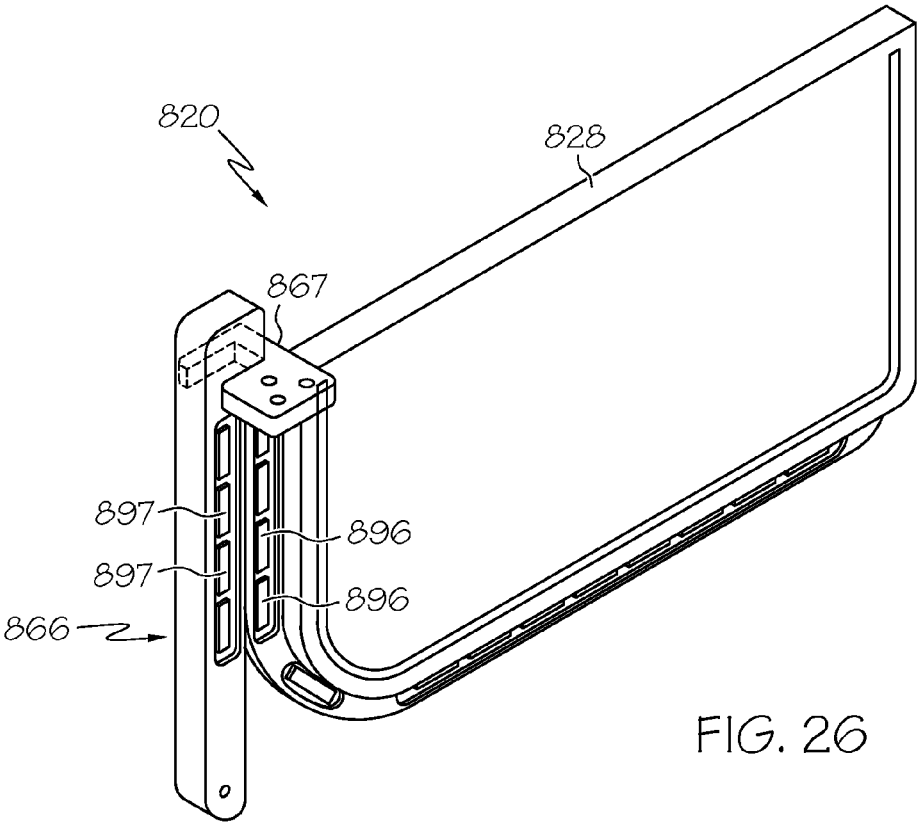
FIG. 26 is a rear perspective view depicting a door and a latch of a bathtub insert according to another embodiment wherein certain components of the bathtub insert have been removed for clarity of illustration.
Figure 27:
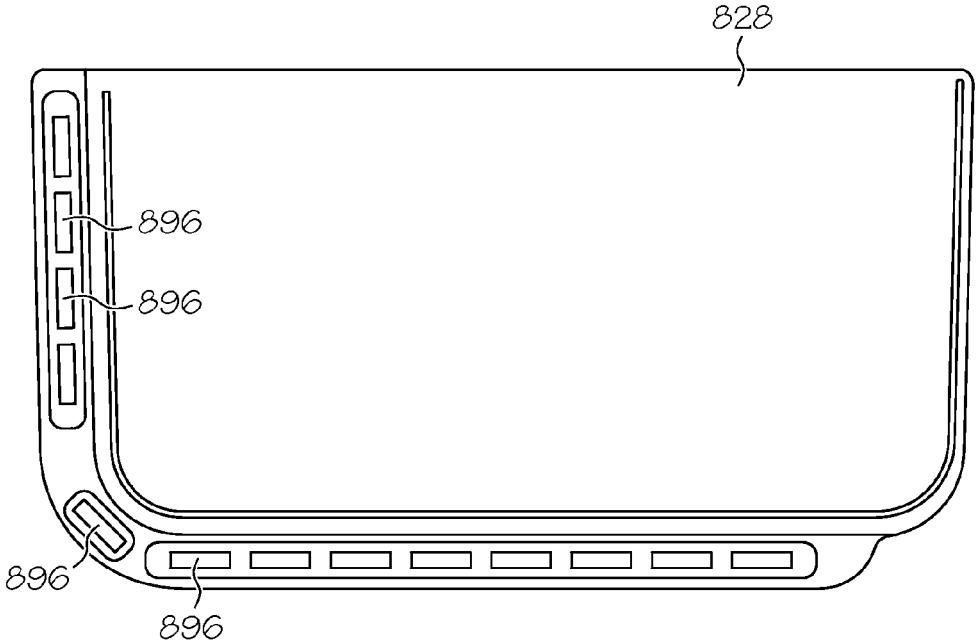
FIG. 27 is a rear elevational view depicting door of the bathtub insert of FIG. 26.

FIGS. 26-27 illustrate a portion of bathtub insert 820 according to yet another embodiment. The bathtub insert 820 can be similar in many respects to the bathtub insert 20 shown in FIGS. 1-6. For example, the bathtub insert 820 can include a door 828. However, a latch 866 can be pivotally coupled to a frame (not shown) and a strike plate 867 (e.g., receiver) can be secured to the frame (not shown). To lock the door 828 in the closed position, the latch 866 can be pivoted into a latched position and into engagement with the strike plate 867, as illustrated in FIG. 26. To unlock the door 828, the latch 866 can be moved into an unlatched position and out of engagement with the strike plate 867.

The door 828 can be provided with a plurality of magnets 896 that are arranged around the periphery of the door 828. The magnets 896 can be associated with corresponding magnet plates embedded or otherwise associated with the frame (not shown) such that when the door 828 is in the closed position, the magnetic coupling between the magnets 896 and the magnet plates resists accidental opening of the door 828. The door 828 can moved to the opened position by pulling the door 828 with enough force to overcome the magnetic coupling. The latch 866 can be provided with a plurality of magnets 897 that are associated with corresponding magnet plates embedded or otherwise associated with the frame (not shown). When the latch 866 is in a latching position, the magnets 897 can align with corresponding magnet plates disposed within the frame (not shown) to retain the latch 866 in the latched position. The magnetic coupling between the magnets 897 and the magnet plates must be overcome to move the latch 866 into the latched position. It will be appreciated that any suitable magnet 897 arrangement is contemplated. For example, another set of magnets can be provided that secures the latch 866 in an unlatched position.

Figure 28:
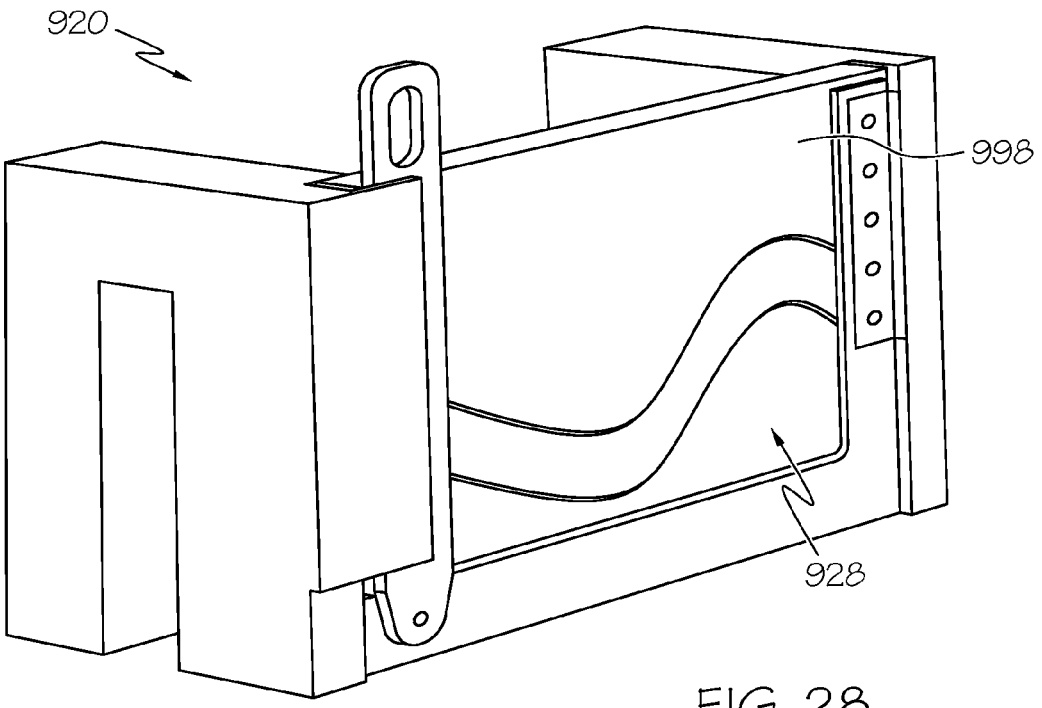
FIG. 28 is a front perspective view depicting a bathtub insert according to still another embodiment.
Figure 29:
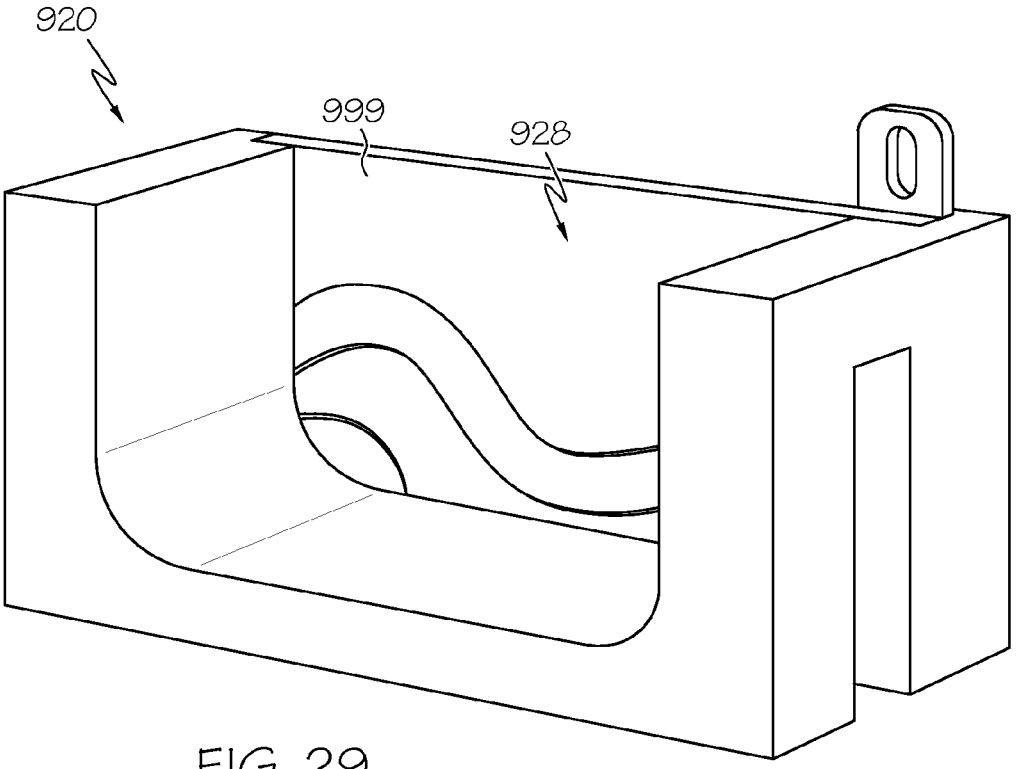
FIG. 29 is a rear perspective view depicting the bathtub insert of FIG. 28.

FIGS. 28-29 illustrate a bathtub insert 920 according to yet another embodiment. The bathtub insert 920 can be similar in many respects to the bathtub insert 620 shown in FIGS. 20-21. For example, the bathtub insert 920 can include a door 928. However, front and rear surfaces 998, 999 of the door 928 can be provided with a decorative feature, such as a wave-like pattern, for example. In one embodiment, the decorative feature can be molded or otherwise formed directly into the door 928. In another embodiment, the decorative feature can be printed or otherwise provided on a laminate that is applied to the door 928 (e.g., with adhesive).

The foregoing description of embodiments and examples has been presented for purposes of illustration and description. It is not intended to be exhaustive or limiting to the forms described. Numerous modifications are possible in light of the above teachings. Some of those modifications have been discussed and others will be understood by those skilled in the art. The embodiments were chosen and described for illustration of various embodiments. The scope is, of course, not limited to the examples or embodiments set forth herein, but can be employed in any number of applications and equivalent devices by those of ordinary skill in the art. Rather it is hereby intended the scope be defined by the claims appended hereto.

What is claimed is:

1. A bathtub insert comprising:

a frame comprising a step-plate and a pair of end pillars, the frame defining a cavity;

a door movably coupled with the frame and movable with respect to the frame between an opened position and a closed position;

a seal coupled to one of the frame and the door to provide a watertight seal between the frame and the door when the door is in the closed position;

an elongate latch coupled with the door with a singular pivot pin having a singular pivot point such that the elongate latch is pivotable relative to the door, the elongate latch having a tapered portion, wherein the singular pivot pin is positioned at a bottom portion of the frame or the door;

a catch coupled with the frame, the catch having a substantially vertical orientation and defining a channel member, the channel member having a substantially vertical orientation and forming a channel having a vertical length that is greater than its horizontal width, wherein the channel member is sized to receive the tapered portion of the elongate latch to retain and tension the door in the closed position to establish a substantially watertight seal between the door and the frame to selectively engage the latch to facilitate retention of the door in the closed position; and a support structure, the support structure being coupled to the frame.

2. The bathtub insert of claim 1, wherein the support structure is coupled to the step plate of the frame.

3. The bathtub insert of claim 1, wherein the support structure provides underlying support for the frame.

4. The bathtub insert of claim 1, where the frame includes a back plate configured to accept at least one fastener associated with the door.

5. The bathtub insert of claim 1, wherein the support structure has a substantially rectangular shape.

6. The bathtub insert of claim 1, wherein the door is movably coupled to the frame with at least one hinge.

7. The bathtub insert of claim 1, wherein the support structure comprises support bracing.

8. The bathtub insert of claim 1, wherein the support structure is integral with the frame such that the support structure and the frame are a one piece construction.

9. The bathtub insert of claim 8, wherein the support structure is integral with the step plate of the frame.

10. A bathtub comprising:

a frame comprising a step-plate and a pair of end pillars, the frame defining a substantially U-shaped cavity;

a door movably coupled with the frame and movable with respect to the frame between an opened position and a closed position such that the door swings inwardly into the bathtub in the opened position;

a seal coupled to one of the frame and the door to provide a watertight seal between the frame and the door when the door is in the closed position;

an elongate latch coupled with the door with a singular pivot pin having a singular pivot point such that the elongate latch is pivotable relative to the door, the elongate latch having a tapered portion, wherein the singular pivot pin is positioned at a bottom portion of the frame or the door; and a catch coupled with the frame, the catch having a substantially vertical orientation and defining a channel member, the channel member having a substantially vertical orientation and forming a channel having a vertical length that is greater than its horizontal width, wherein the channel member is sized to receive the tapered portion of the elongate latch to retain and tension the door in the closed position to establish a substantially watertight seal between the door and the frame.

11. The bathtub of claim 1, further comprising a support structure, the support structure being coupled to the frame.

12. The bathtub insert of claim 11, wherein the support structure is coupled to the step plate of the frame.

13. The bathtub insert of claim 11, wherein the support structure provides underlying support for the frame.

14. The bathtub insert of claim 1, wherein the support structure comprises support bracing.

15. The bathtub insert of claim 11, wherein the support structure is integral with the frame such that the support structure and the frame are a one piece construction.

16. The bathtub insert of claim 15, wherein the support structure is integral with the step plate of the frame.

17. The bathtub insert of claim 11, wherein the frame is integral with the bathtub.

18. The bathtub insert of claim 11, wherein the step plate includes a treaded portion.

19. A bathtub insert comprising:

a frame comprising a step-plate and a pair of end pillars, the frame defining a cavity;

a door movably coupled with the frame and movable with respect to the frame between an opened position and a closed position;

a seal coupled to one of the frame and the door to provide a watertight seal between the frame and the door when the door is in the closed position;

an elongate latch coupled with the door with a singular pivot pin having a singular pivot point such that the elongate latch is pivotable relative to the door, the elongate latch having a tapered portion, wherein the singular pivot pin is positioned at a bottom portion of the frame or the door;

a catch coupled with the frame, the catch having a substantially vertical orientation and defining a channel member, the channel member having a substantially vertical orientation and forming a channel having a vertical length that is greater than its horizontal width, wherein the channel member is sized to receive the tapered portion of the elongate latch to retain and tension the door in the closed position to establish a substantially watertight seal between the door and the frame to selectively engage the latch to facilitate retention of the door in the closed position; and a support structure, wherein the support structure is integral with the frame such that the support structure and the frame are a one piece construction.

20. The bathtub insert of claim 19, wherein the support structure extends in a generally downward direction from the frame to a floor of the bathtub.

* * * * *